US006034643A

United States Patent [19]

Nishikawa et al.

[11] Patent Number: 6,034,643

[45] Date of Patent: Mar. 7, 2000

[54] DIRECTIONAL BEAM ANTENNA DEVICE AND DIRECTIONAL BEAM CONTROLLING APPARATUS

[75] Inventors: Kunitoshi Nishikawa, Gifu-ken; Tomohisa Harada, Aichi-ken; Toshiaki Watanabe, Aichi-ken; Masaru Ogawa, Aichi-ken; Eiji Teramoto, Aichi-ken, all of Japan

[73] Assignee: Kabushiki Kaisha Toyota Chuo Kenkyusho, Aichi-gun, Japan

[21] Appl. No.: 09/045,711

[22] Filed: Mar. 23, 1998

[30] Foreign Application Priority Data

Mar. 28, 1997 [JP] Japan ..... 9-078257
Mar. 28, 1997 [JP] Japan ..... 9-078258

[51] Int. Cl.[7] ..... H01Q 3/10

[52] U.S. Cl. ..... 343/765; 343/882; 74/469; 248/179

[58] Field of Search ..... 343/765, 757, 343/880, 878; 74/469; 248/179, 183

[56] References Cited

U.S. PATENT DOCUMENTS

| | | | |
|---|---|---|---|
| 3,407,404 | 10/1968 | Cook et al. | 343/765 |
| 4,819,002 | 4/1989 | Reboullet | 343/765 |
| 5,025,262 | 6/1991 | Abdelrazik et al. | 343/705 |
| 5,453,753 | 9/1995 | Cosenza et al. | 343/765 |
| 5,619,215 | 4/1997 | Sydor | 343/766 |

FOREIGN PATENT DOCUMENTS

| | | |
|---|---|---|
| 8-162833 | 6/1996 | Japan . |
| WO 94/17564 | 8/1994 | WIPO . |

OTHER PUBLICATIONS

Patent Abstracts of Japan, vol. 17, No. 542 (E–1441), Sep. 29, 1993, JP 05 152824, Jun. 18, 1993.

Patent Abstracts of Japan, vol. 96, No. 10, Oct. 31, 1996, JP 08 162833, Jun. 21, 1996.

*Primary Examiner*—Hoanganh Le
*Assistant Examiner*—James Clinger
*Attorney, Agent, or Firm*—Oblon, Spivak, McClelland, Maier & Neustadt, P.C.

[57] ABSTRACT

A directional beam antenna device includes: an antenna supporting member which is supported on a base in such a manner as to be rotatable about a first rotational axis; an antenna portion which is supported on the antenna supporting member in such a manner as to be rotatable about a second rotational axis which is perpendicular to an antenna aperture and is inclined at a first angle with respect to the first rotational axis, the direction of an antenna beam being inclined at a second angle with respect to the second rotational axis; a first driving unit for rotating the antenna supporting member about the first rotational axis with respect to the base; and a second driving unit for rotating the antenna portion about the second rotational axis with respect to the antenna supporting member. A directional beam controlling apparatus is provided with a controlling unit for controlling an elevation angle of the antenna beam to a target value by causing the second driving unit to rotate the antenna portion with respect to the antenna supporting member, and for controlling an azimuth angle of the antenna beam to a target value by causing the first driving unit to rotate the antenna supporting member with respect to the base.

15 Claims, 20 Drawing Sheets

DIRECTIONAL BEAM ANTENNA DEVICE AND DIRECTIONAL BEAM CONTROLLING APPARATUS

BACKGROUND OF THE INVENTION

1. Field of the Invention

The present invention relates to a directional beam antenna device and a directional beam controlling apparatus, and more particularly to a directional beam antenna device and a directional beam controlling apparatus which are suitable as an antenna for a mobile earth station in communications using a satellite.

2. Description of the Related Art

In a case where an earth station is a mobile object such as a vehicle or a vessel in communications using a satellite, an antenna for the earth station is required to be capable of effecting communication satisfactorily without being affected by a change in the location or attitude of the mobile object. In a case where the moving range of the mobile object is relatively narrow, even if the location of the mobile object has changed, the change in the angle of the satellite as viewed from the mobile object in a vertical plane including both the mobile object and the satellite (hereafter, this angle in the vertical plane will be referred to as the "elevation angle," and the direction in the vertical plane as the "direction of the elevation angle") is small. Therefore, an antenna apparatus is used which is arranged such that a low-gain antenna which is omnidirectional in a horizontal plane is fixedly disposed such that the direction in which the antenna gain becomes maximum in the vertical plane will substantially coincide with the elevation angle of the satellite.

However, to obtain more satisfactory communication quality, by using an antenna having a high gain and sharp directivity, i.e., a directional antenna having a directivity pattern in which the half-power beam width of the main lobe of an antenna beam is small, it is desirable to change and control the direction of the antenna beam (the direction of the boresight (the principal axis of directivity) of the antenna) in correspondence with the direction of the satellite which changes with the change in the location or attitude of the mobile object.

As an antenna apparatus for a mobile earth station which is capable of changing the direction of the antenna beam, an apparatus is known in which, as shown in Japanese Patent Application Laid-Open (JP-A) No. 6-283919, a circular plane antenna is rotatably supported at two opposing points of its end portions, and the plane antenna is rotated about an axis connecting the two points so as to control the elevation angle of the antenna beam, and the overall antenna (the plane antenna and a member supporting the plane antenna) is rotated about an axis extending in the vertical direction so as to control the direction in the horizontal plane of the antenna beam (hereafter, the angle extending along the horizontal direction will be referred to as the "azimuth angle," and the direction in the horizontal plane as the "direction of the azimuth angle).

However, with the antenna device having the above-described configuration, the change in the rotation angle, per se, at a time when the plane antenna is rotated about the axis connecting the two points supporting the plane antenna becomes the change in the elevation angle of the antenna beam, so that there has been a problem that a complex elevation-angle controlling mechanism is required for accurately controlling the elevation angle of the antenna beam. In addition, in the case where the above-described antenna device is used by being mounted on a mobile object such as a vehicle, the antenna itself vibrates in the direction of the elevation angle due to the vibration of the mobile object, and the elevation angle of the antenna beam is frequently offset from the direction of the satellite, so that it has been difficult to put such an antenna device to practical use.

In addition, Japanese Patent Application Laid-Open (JP-A) No. 8-162833 discloses a vehicle-mounted antenna device for satellite communication which is arranged such that an antenna supporting member is supported on a base in such a manner as to be rotatable about a first rotational axis extending along a vertical direction, a plane antenna is supported on the antenna supporting member in such a manner as to be rotatable about a second rotational axis which is not perpendicular to the first rotational axis and is inclined by an angle substantially equal to the elevation angle of a satellite, and a driving mechanism for rotating the antenna supporting member about the first rotational axis is provided.

With the plane antenna in the above-described antenna device, the direction of the antenna beam coincides with an axial direction perpendicular to the aperture of the antenna, i.e., coincides with the direction of the second rotational axis. In addition, with the above-described antenna device, only the rotation of the antenna supporting member about the first rotational axis is actively controlled in correspondence with a change in the location or direction of the mobile object. The plane antenna is passively rotated about the second rotational axis by the torsional force occurring due to the rotation of the antenna supporting member, and the occurrence of twisting of a cable and the like accompanying the relative rotation of the plane antenna with respect to the base is prevented.

However, with the above-described antenna device, the angle of the plane antenna in the vertical plane is fixed to an angle perpendicular to the second rotational axis, and the elevation angle of the antenna beam of the plane antenna is also fixed, it is impossible to control the elevation angle of the antenna beam in a case where the elevation angle of the satellite as viewed from the mobile object has changed by accompanying a change in the attitude in the direction of the elevation angle of the mobile object (e.g., in a case where a vehicle as the mobile object is traveling on a road having a gradient) or in a case where the moving range of the mobile object is so wide that the change in the elevation angle of the satellite cannot be ignored. Thus there has been a problem in that the communication quality in satellite communication deteriorates.

SUMMARY OF THE INVENTION

The present invention has been devised to overcome the above-described problems, and a primary object of the present invention is to provide a directional beam antenna device which is capable of adjusting the elevation angle and the azimuth angle of the antenna beam, and is capable of suppressing a change in the elevation angle of the antenna beam even if a disturbance or the like is applied.

A secondary object of the present invention is to provide a directional beam controlling apparatus which is capable of reliably controlling the elevation angle and the azimuth angle of the antenna beam to desired angles irrespective of the disturbance or the like.

To attain the above-described primary object, in accordance with a first aspect of the present invention, there is provided a directional beam antenna device comprising: an antenna supporting member which is supported on a base in such a manner as to be rotatable about a first rotational axis; an antenna portion which is supported on the antenna supporting member in such a manner as to be rotatable about a second rotational axis which is perpendicular to an antenna aperture and is inclined by a first angle with respect to the first rotational axis, the direction of an antenna beam being inclined by a second angle with respect to the second rotational axis; first driving means for rotating the antenna supporting member about the first rotational axis with respect to the base; and second driving means for rotating the antenna portion about the second rotational axis with respect to the antenna supporting member.

In the present invention, the antenna supporting member is supported on the base in such a manner as to be rotatable about the first rotational axis, the first driving means is provided for rotating the antenna supporting member about the first rotational axis with respect to the base, and the antenna portion is supported on the antenna supporting member. For this reason, if the directional beam antenna device in accordance with the present invention is arranged such that the first rotational axis extends substantially along the vertical direction, the first driving means rotates the antenna supporting member about the first rotational axis, with the result that the direction of the antenna beam (the direction in which the gain of the antenna portion becomes maximum) is also rotated about the first rotational axis within the horizontal plane, thereby making it possible to change only the azimuth angle of the antenna beam.

In addition, the antenna portion is supported on the antenna supporting member in such a manner as to be rotatable about the second rotational axis which is perpendicular to the antenna aperture and is inclined by the first angle with respect to the first rotational axis, and the direction of the antenna beam is inclined by the second angle with respect to the second rotational axis. Further, the second driving means is provided for rotating the antenna portion about the second rotational axis with respect to the antenna supporting member. For this reason, in a case where the second driving means has rotated the antenna portion about the second rotational axis, the direction of the antenna beam rotates about the second rotational axis while maintaining its state of being inclined by the second angle with respect to the second rotational axis. Thus the point of intersection between an imaginary plane perpendicular to the second rotational axis and the direction of the antenna beam depicts a circle having as its center a point of intersection between the second rotational axis and the aforementioned imaginary plane.

Accordingly, if the directional beam antenna device in accordance with the present invention is arranged such that the first rotational axis extends substantially along the vertical direction, and if it is assumed that the first angle is $\theta_1$ and the second angle $\theta_2$, the elevation angle $\theta$ of the antenna beam changes in the range of $\pi/2-(\theta_1+\theta_2)\leqq\theta\leqq\pi/2-(\theta_1-\theta_2)$ in conjunction with the rotation of the antenna portion. Accordingly, by causing the second driving means to rotate the antenna portion about the second rotational axis, the direction of the antenna beam can be changed to the direction of the elevation angle. Then, if the first angle $\theta_1$ and the second angle $\theta_2$ are set by taking into consideration the elevation angle, as viewed from the antenna portion, of the object to which the antenna beam is to be oriented (e.g., a satellite) as well as an amount of its change, the antenna beam can always be directed toward the object of orientation.

It should be noted that the direction of the antenna beam changes in the direction of the azimuth angle as well in conjunction with the rotation of the antenna portion, but since the change in the direction of the antenna beam in the case where the antenna supporting member is rotated about the first rotational axis takes place only in the direction of the azimuth angle, so that by causing the first driving means to rotate the antenna supporting member about the first rotational axis, the azimuth angle of the antenna beam can be adjusted arbitrarily. Thus the directional beam antenna device in accordance with the present invention is able to adjust the azimuth angle and the elevation angle of the antenna beam such that the antenna beam is always directed toward the object of orientation.

Further, in the present invention, even if the antenna portion has undergone one rotation about the second rotational axis, the elevation angle $\theta$ of the antenna beam only changes in the range of $\pi/2-(\theta_1+\theta_2)\leqq\theta\leqq\pi/2-(\theta_1-\theta_2)$ (where $\theta_2<\pi/2$), the change in the elevation angle $\theta$ of the antenna beam with respect to the rotation of the antenna portion is clearly small in comparison with the antenna device disclosed in Japanese Patent Application Laid-Open (JP-A) No. 6-283919 (with the antenna device disclosed in Japanese Patent Application Laid-Open (JP-A) No. 6-283919, the elevation angle of the antenna beam changes by the angle of rotation of the antenna portion, i.e., if the antenna portion undergoes one rotation, the elevation angle of the antenna beam also changes by $2\pi$ (=360°).

Thus, with the directional beam antenna device in accordance with the present invention, since the change in the elevation angle of the antenna beam with respect to the angle of rotation of the antenna portion about the second rotational axis is small, the elevation angle of the antenna beam can be accurately controlled to a desired angle.

It should be noted that, in the present invention, the antenna supporting member can be formed in such a shape of a circular cylinder that one axial end surface (or an imaginary plane closing the one end portion) is perpendicular to the axis, while another axial end surface (or an imaginary plane closing the other end portion) forms an angle corresponding to ($\pi/2$-first angle) with respect to the axis, i.e., in such a shape that the other end portion side is inclined by the first angle (perpendicular to the second rotational axis). In this case, the antenna supporting member is disposed on the base such that the one end portion of the antenna supporting member is located on the base side, and the antenna portion can be disposed on the other end portion of the antenna supporting member along the inclination of the other end portion.

As a result, if the surface of the base where the antenna supporting member is disposed is substantially horizontal, the axis of the cylindrical antenna supporting member becomes substantially parallel with the vertical direction, and if the antenna supporting member is rotated by using the axis as the first rotational axis, it is possible to change only the azimuth angle of the antenna beam of the antenna portion disposed on the antenna supporting member. In addition, the second rotational axis can be set as an axis which is perpendicular to the antenna portion-side end surface of the antenna supporting member, and if the antenna portion is rotated about the axis perpendicular to the antenna portion-side end surface, it is possible to change the elevation angle of the antenna beam.

In the above-described configuration, the antenna portion-side end surface of the antenna supporting member is inclined by the first angle, and since the antenna portion is disposed on this antenna portion-side end surface in such a manner as to extend along the inclination, an arrangement can be provided such that the antenna portion is always supported over its entire periphery by the antenna portion-side end surface of the antenna supporting member (i.e., supported by a plane). Consequently, it is possible to suppress the change in the elevation angle of the antenna beam in a case where a disturbance or the like is applied.

In addition, the rotation of the antenna supporting member and the antenna portion in the above-described manner can be attained by the provision of a first rotatably supporting portion for rotatably supporting the antenna supporting member on the base as well as a second rotatably supporting portion for rotatably supporting the antenna portion on the antenna supporting member. If members having small friction due to rotation such as bearings are used as the first and second rotatably supporting portions, it is possible to reduce the driving force required for the first driving means for rotating the antenna supporting member and the driving force required for the second driving means for rotating the antenna portion.

In the present invention, as the antenna portion, it is preferable to use a planar antenna (e.g., a slot array antenna or a microstrip array antenna using a radial waveguide). By using such an antenna portion, the directional beam antenna device in accordance with the present invention can be arranged to be compact and lightweight.

In the present invention, as the antenna portion, more specifically it is possible to use an antenna in which the direction of the antenna beam is electronically inclined by a predetermined angle with respect to the direction of the normal line of the radiational aperture. In addition, by arranging the antenna portion by including a member for inclining the radiational aperture, the direction of the antenna beam may be mechanically inclined by the second angle with respect to the direction along the second rotational axis.

In the present invention, the first driving means for rotating the antenna supporting member can be provided on, for instance, the antenna supporting member side, but should be preferably provided on the base side. By so doing, it is possible to suppress an increase in the weight of the antenna supporting member which is rotated with respect to the base, and the driving force required for the first driving means for rotating the antenna supporting member can be made small.

In the present invention, the second driving means for rotating the antenna portion can also be provided on, for instance, the antenna supporting member or the antenna portion, but should also be preferably provided on the base side. By so doing, the driving force required for the second driving means for rotating the antenna portion can be made small for the same reason as described above.

Incidentally, the position of the end portion of the antenna portion as viewed from the base side moves in the direction along the first rotational axis and in the direction perpendicular to the first rotational axis (moves substantially along the vertical direction and the horizontal direction if it is assumed that the first rotational axis is arranged substantially along the vertical direction) in conjunction with the rotation of the antenna supporting member. Accordingly, in a case where the arrangement provided is such that the second driving means is provided on the base side and is rotated in contact with the antenna portion, the second driving means should be preferably arranged in such a manner as to slide on the base in correspondence with the change in the position of the end portion of the antenna portion. By adopting such an arrangement, the antenna portion can be rotated reliably without an increase in the weight of the portions which are rotated (the antenna portion and the antenna supporting member).

In the present invention, as for the feeding of the antenna portion, it is preferable to feed a feeding portion of the antenna on a non-contact basis. Specifically, a feed line is provided which is fixed to the base or the antenna supporting member, and whose distal end is inserted in a small hole provided at the center of rotation of the antenna portion. By so doing, since the antenna portion and the antenna supporting member or the base which undergoes relative rotation with respect to the antenna portion are coupled with each other on a non-contact basis, the deterioration over time due to wear or the like does not occur, and it is possible to prevent a decline in the communication performance over time.

In addition, as for the feeding of the antenna portion, a rotary joint may be provided between relatively rotating members, i.e., in at least one of a space between the antenna portion and the antenna supporting member and a space between the base and the antenna supporting member, and the antenna may be fed via the rotary joint. Still alternatively, feeding may be effected by providing a flexible feed line having end fixed to the base and the other end connected rotatably to the feeding portion of the antenna by means of a rotatively holding member such as a bearing. By so doing, particularly in a case where the angle of inclination of the antenna portion with respect to the base is large, it is possible to suppress an increase in the loss occurring in the feeding portion.

Further, in the feeding of the antenna portion, the antenna supporting member may be provided with a frequency conversion circuit, and the antenna portion may be fed via the frequency conversion circuit. Incidentally, in the case where the frequency conversion circuit is provided, the frequency conversion circuit is preferably provided with a feeding probe whose distal end is inserted in a small hole provided in the center of rotation of the antenna portion to effect coupling with the antenna portion. By so doing, it is possible to minimize the deterioration in the carrier to noise (C/N) ratio in the reception in a case where the antenna portion is used as a receiving antenna. In addition, if an arrangement is provided such that a signal inputted from the antenna portion is converted to a lower frequency by the frequency conversion circuit, a relatively inexpensive rotary joint for a relatively lower frequency band can be used in the case where feeding is effected by providing the rotary joint between the base and the antenna supporting member.

As described above, in accordance with the first aspect of the present invention, the antenna supporting member is provided which is supported on the base in such a manner as to be rotatable about the first rotational axis, and the antenna portion is provided which is supported on the antenna supporting member in such a manner as to be rotatable about the second rotational axis which is perpendicular to the antenna aperture and is offset by the first angle with respect to the first rotational axis, the direction of the antenna beam being offset by the second angle with respect to the second rotational axis. The antenna supporting member is driven about the first rotational axis by the first driving means, and the antenna portion is driven by the second driving means. Therefore, an outstanding advantage is offered in that the elevation angle and the azimuth angle of the antenna beam are made adjustable, and it is possible to suppress the change in the elevation angle of the antenna beam even if a disturbance or the like is applied.

To attain the above-described second object, in accordance with a second aspect of the present invention, there is provided a directional beam controlling apparatus comprising: an antenna supporting member which is supported on a base in such a manner as to be rotatable about a first rotational axis extending substantially along a vertical direction; an antenna portion which is supported on the antenna supporting member in such a manner as to be rotatable about a second rotational axis which is perpendicular to an antenna aperture and is inclined by a first angle with respect to the first rotational axis, the direction of an antenna beam being inclined by a second angle with respect to the second rotational axis; first driving means for rotating the antenna supporting member about the first rotational axis with respect to the base; second driving means for rotating the antenna portion about the second rotational axis with respect to the antenna supporting member; and controlling means for controlling an elevation angle of the antenna beam to a target value by causing the second driving means to rotate the antenna portion with respect to the antenna supporting member, and for controlling an azimuth angle of the antenna beam to a target value by causing the first driving means to rotate the antenna supporting member with respect to the base.

In the present invention, the antenna supporting member of the antenna device described in the first aspect of the invention is supported on the base in such a manner as to be rotatable about the first axis extending substantially along the vertical direction, and the elevation angle and the azimuth angle are controlled to target values by the controlling means. Although the direction of the antenna beam changes in the direction of the azimuth angle as well in conjunction with the rotation of the antenna portion, the change in the direction of the antenna beam in a case where the antenna supporting member is rotated about the first rotational axis takes place only in the direction of the azimuth angle. For this reason, the controlling means controls the elevation angle of the antenna beam to a target value by causing the second driving means to rotate the antenna portion with respect to the antenna supporting member, and controls the azimuth angle of the antenna beam to a target value by causing the first driving means to rotate the antenna supporting member with respect to the base.

Accordingly, as the controlling means controls the azimuth angle of the antenna beam to a target value by allowing the antenna supporting member to be rotated with respect to the base, the change in the azimuth angle of the antenna beam accompanying the rotation of the antenna portion is also corrected, thereby making it possible to control the elevation angle and the azimuth angle of the antenna beam to desired angles (target values). Then, if the elevation angle and the azimuth angle of the object of orientation of the antenna beam as viewed from the antenna device are used as the target values of the elevation angle and the azimuth angle of the antenna beam, the azimuth angle and the elevation angle of the antenna beam can be controlled such that the antenna beam is directed to the object of orientation.

In the present invention, the control of the elevation angle of the antenna beam by the controlling means can be specifically realized by calculating the rotation angle of the antenna portion for allowing the elevation angle of the antenna beam to agree with the target value, and by rotating the antenna portion by the calculated rotation angle with respect to the antenna supporting member by means of the second driving means. In addition, the control of the azimuth angle of the antenna beam by the controlling means can be realized by calculating the rotation angle of the antenna supporting member for allowing the azimuth angle of the antenna beam to agree with the target value, and by rotating the antenna supporting member by the calculated rotation angle with respect to the base by means of the first driving means.

In the aforementioned calculation of the rotation angle, it is necessary for the controlling means to recognize the present angle of the antenna supporting member about the first rotational axis with respect to the base as well as the present angle of the antenna portion about the second rotational axis with respect to the antenna supporting member. As for these rotation angles, by providing a first rotation-angle detecting means for protecting the rotation angle of the antenna supporting member with respect to the base as well as a second rotation-angle detecting means for detecting the rotation angle of the antenna portion with respect to the antenna supporting member, the rotation angles can be recognized on the basis of the results of detection by these rotation-angle detecting means.

In addition, by the provision of the aforementioned rotation-angle detecting means, it becomes possible to provide the so-called feedback control in which the first and second driving means are controlled such that the antenna supporting member and the antenna portion will be rotated by the calculated rotation angles, while monitoring whether the antenna supporting member and the antenna portion have been rotated by the calculated rotation angles on the basis of the rotation angles detected by the rotation-angle detecting means. Hence, the elevation angle and the azimuth angle of the antenna beam can be controlled with high accuracy.

In addition, instead of the rotation-angle detecting means, it is possible to use detecting means of a type for detecting whether or not the angle of the antenna supporting member about the first rotational axis with respect to the base and the angle of the antenna portion about the second rotational axis with respect to the antenna supporting member are specific angles (e.g., limit switches or the like). In this case, if driving means capable of rotating objects of rotation by rotation angles accurately corresponding to instructions from the controlling means (e.g., stepping motors or the like) are used, the controlling means is capable of automatically recognizing the rotation angles (i.e., present angles) of the antenna supporting member and the antenna portion from the specific angles.

In the present invention, in a case where the antenna supporting member is rotated by the first driving means for the purpose of changing the azimuth angle of the antenna beam, it is preferable to rotate the antenna portion integrally with the antenna supporting member. Depending on the structure and the like for rotatably supporting the antenna portion, however, if the antenna supporting member is rotated by the first driving means, there are cases where the antenna portion is relatively rotated with respect to the antenna supporting member. If such a case is taken into account, it is preferable for the controlling means to control the second driving means such that the antenna portion will not relatively rotate with respect to the antenna supporting member.

The aforementioned control can be realized by providing the second rotation-angle detecting means described before, by determining the change in the angle of the antenna portion about the second rotational axis with respect to the antenna supporting member on the basis of the rotation angle of the antenna portion with respect to the antenna supporting member detected by the second rotation-angle detecting means when the antenna supporting member is rotated by the first driving means, and by rotating the antenna portion by means of the second driving means such that the changed angle will return to its former state.

In the present invention, in the mode in which the elevation angle and the azimuth angle of the antenna beam are controlled by the controlling means such that the antenna beam will be directed toward the object of orientation, the elevation angle and the azimuth angle of the object of orientation as viewed from the antenna device change frequently. For instance, in a case where the directional beam controlling apparatus in accordance with the present invention is mounted in a mobile object, the elevation angle and the azimuth angle of the object of orientation changes in conjunction with the change in the location and attitude of the mobile object.

For this reason, it is preferable to provide angular-change detecting means for detecting at least one of the change in the elevation angle and the change in the azimuth angle with respect to the object of orientation of the antenna beam in a case where at least one of the elevation angle and the azimuth angle of the object of orientation of the antenna beam as viewed from the antenna device undergoes a change, and it is preferable for the controlling means to change at least one of the target value of the elevation angle of the antenna beam and the target value of the azimuth angle of the antenna beam on the basis of at least one of the change in the elevation angle and the change in the azimuth angle with respect to the object of orientation of the antenna beam detected by the angular-change detecting means. Consequently, the antenna beam can always be directed toward the object of orientation irrespective of at least one of the change in the elevation angle and the change in the azimuth angle of the object of orientation of the antenna beam as viewed from the antenna device.

It should be noted that in a case where the directional beam controlling apparatus in accordance with the present invention is mounted in the mobile object, the angular-change detecting means for detecting at least one of the change in the elevation angle and the change in the azimuth angle of the object of orientation of the antenna beam may be constituted by, for example, at least one of elevation-angle-change detecting means for detecting the change in the elevation angle of the object of orientation of the antenna beam by detecting a change in a location and an attitude of a mobile object and azimuth-angle-change detecting means for detecting the change in the azimuth angle of the object of orientation of the antenna beam by detecting the change in the location and the attitude of the mobile object.

In addition, in a case where some electromagnetic wave (e.g., a beacon wave or the like from the satellite) is transmitted from the object of orientation, the angular-change detecting means for detecting at least one of the change in the elevation angle and the change in the azimuth angle of the object of orientation of the antenna beam may be constituted by, for example, arriving-direction detecting means for detecting at least one of the elevation angle and the azimuth angle of the direction of arrival of the electromagnetic wave by detecting the received signal level of the electromagnetic wave transmitted from the object of orientation and received by the antenna portion.

As described above, in the present invention, the arrangement provided is such that the antenna supporting member is provided which is supported on the base in such a manner as to be rotatable about the first rotational axis extending substantially along a vertical direction, and the antenna portion is provided which is supported on the antenna supporting member in such a manner as to be rotatable about the second rotational axis which is perpendicular to the antenna aperture and is inclined by the first angle with respect to the first rotational axis, the direction of an antenna beam being inclined by the second angle with respect to the second rotational axis. Further, the antenna portion is rotated with respect to the antenna supporting member by the second driving means so as to control the elevation angle of the antenna beam to a target value, and the antenna supporting member is rotated with respect to the base by the first driving means so as to control the azimuth angle of the antenna beam to a target value. Accordingly, an outstanding advantage is offered in that the elevation angle and the azimuth angle of the antenna beam can be controlled reliably to desired angles irrespective of a disturbance or the like.

The above and other objects, features and advantages of the present invention will become more apparent from the following detailed description of the invention when read in conjunction with the accompanying drawings.

DESCRIPTION OF THE PREFERRED EMBODIMENTS

Referring now to the accompanying drawings, a detailed description will be given of the embodiments of the present invention.

First Embodiment

Figure 1:
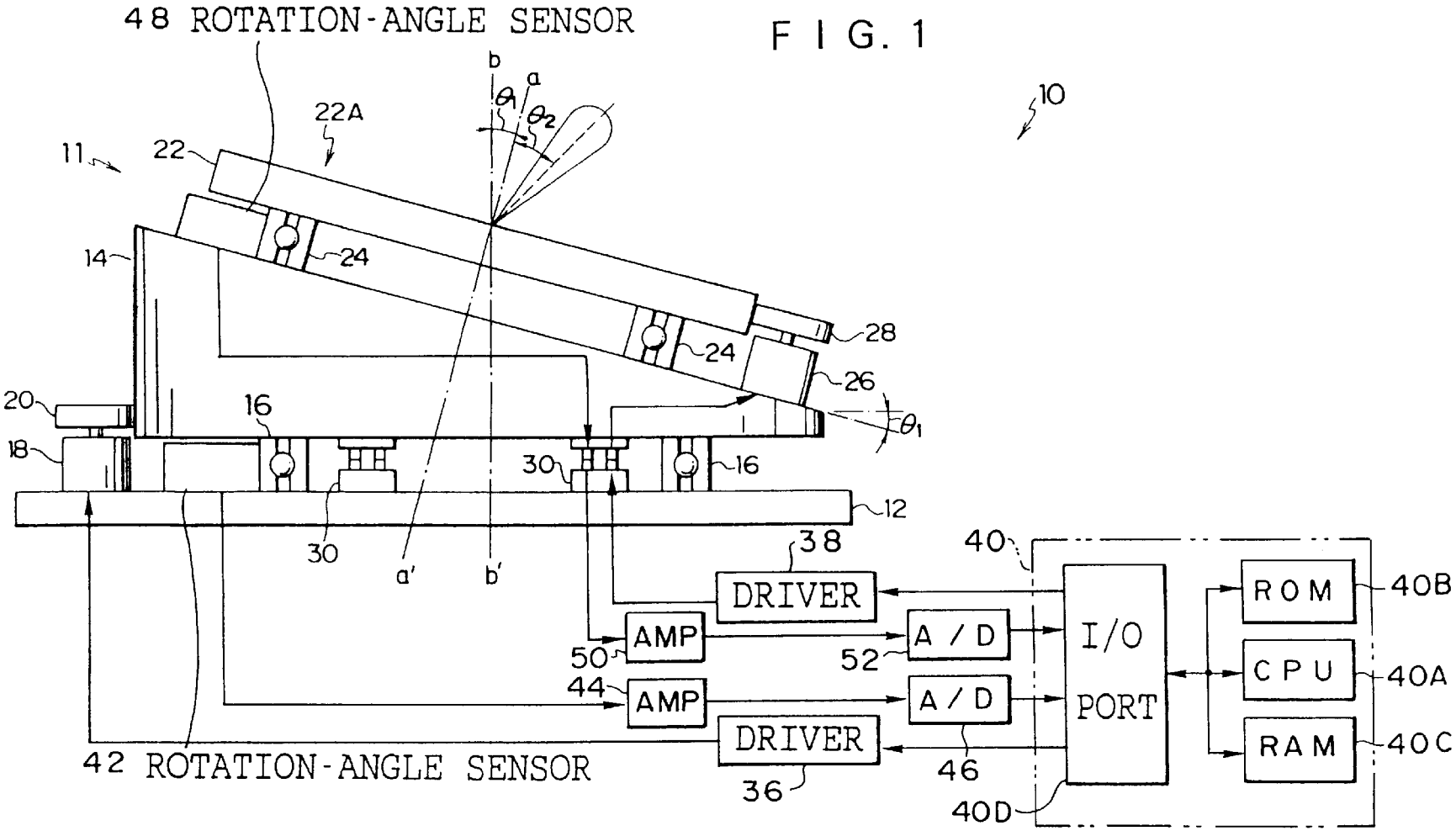
FIG. 1 is a schematic diagram of a directional beam controlling apparatus in accordance with a first embodiment.
Figure 2:
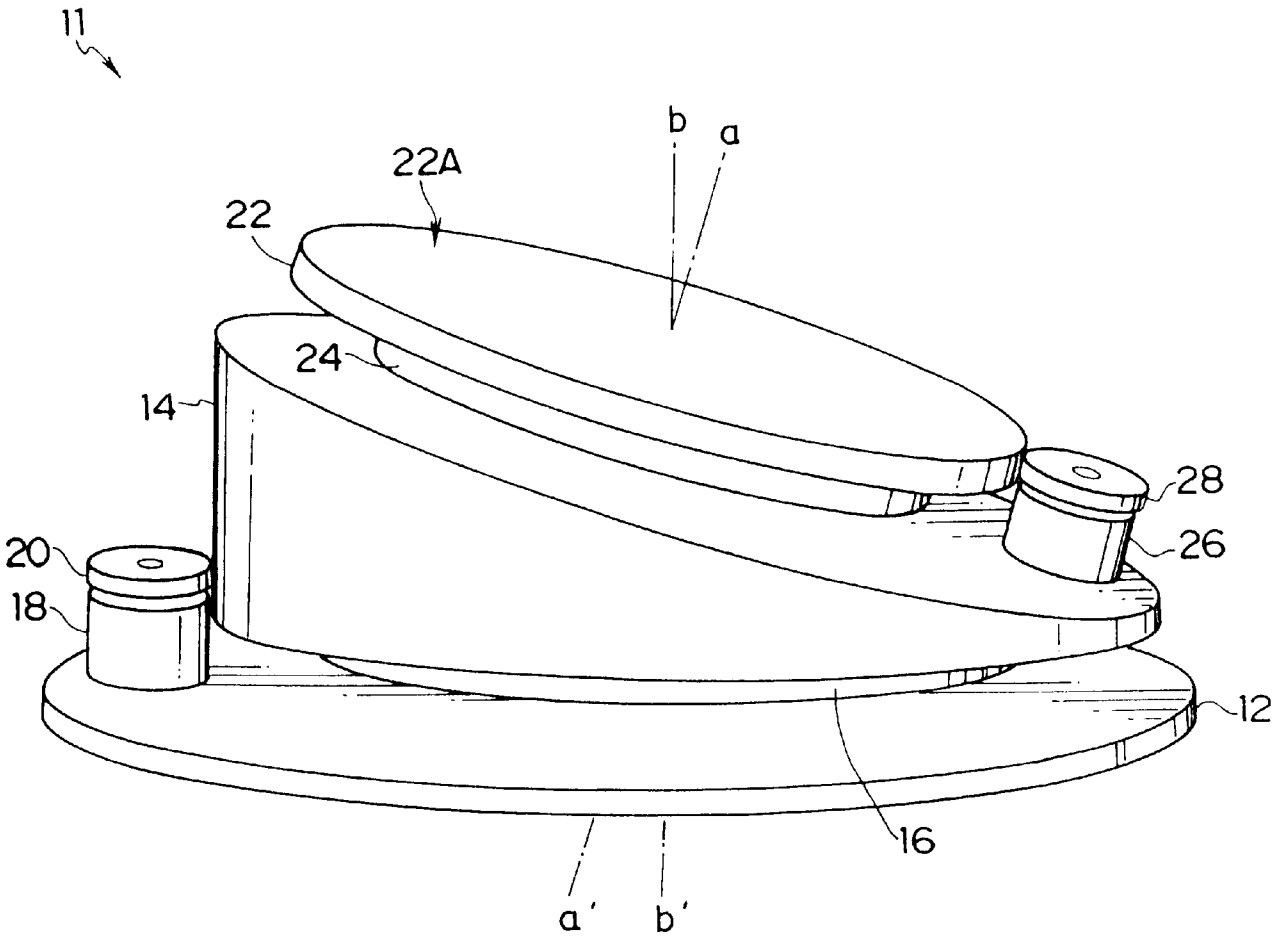
FIG. 2 is a perspective view of an antenna device.

FIG. 1 shows a directional beam controlling apparatus 10 in accordance with a first embodiment. Hereafter, a description will be first given of mechanical portions (generally referred to as an antenna device 11) of the directional beam controlling apparatus 10. As also shown in FIG. 2, the antenna device 11 has a disk-shaped base 12 for supporting the entire antenna device 11, and an antenna supporting base 14 serving as an antenna supporting member of the present invention is disposed above the base 12.

The antenna supporting base 14 is constructed such that a circular cylinder at one axial end thereof is cut along a plane perpendicular to the axis, while the circular cylinder at another axial end thereof is cut along a plane which forms an angle of $(\pi/2-\theta_1)$ with respect to the axis, with the two ends closed. It should be noted that the angle $\theta_1$ corresponds to a first angle of the present invention. The antenna supporting base 14 is arranged such that its end surface which is perpendicular to the axis of the circular cylinder (hereafter, this end surface will be referred to as the "perpendicular surface," and the opposite end surface as the "inclined surface") faces the base 12, and this perpendicular surface becomes parallel with the upper surface of the base 12 (i.e., such that the axis (line b–b' shown in FIGS. 1 and 2) of the circular cylinder becomes perpendicular to the surface of the base 12).

A first bearing 16 serving as a first rotatably supporting portion is disposed between the base 12 and the antenna supporting base 14. The antenna supporting base 14 is supported by the base 12 via the first bearing 16 in such a manner as to be rotatable about the axis of the circular cylinder. The axis (line b–b') of the circular cylinder of the antenna supporting base 14 corresponds to a first rotational axis of the present invention, and will be hereafter referred to as the "first rotational axis."

A first motor 18 is disposed on the base 12. A roller 20, which is formed of a material of a high coefficient of friction such as rubber, is attached to a rotating shaft of the first motor 18. The first motor 18 is disposed on a outer peripheral side of the antenna supporting base 14 such that the roller 20 comes into contact with the peripheral surface of the antenna supporting base 14. When the first motor 18 is driven, the driving force of the first motor 18 is transmitted to the antenna supporting base 14 via the roller 20, with the result that the antenna supporting base 14 is rotated about the first rotational axis. The first motor 18 and the roller 20 correspond to a first driving means of the present invention.

In addition, a disk-shaped antenna 22 (corresponding to an antenna portion of the present invention) is disposed along the inclination of the inclined surface of the antenna supporting base 14, and an antenna aperture 22A of the antenna 22 is inclined by the angle $\theta_1$ with respect to the upper surface of the base 12.

Figure 4A:
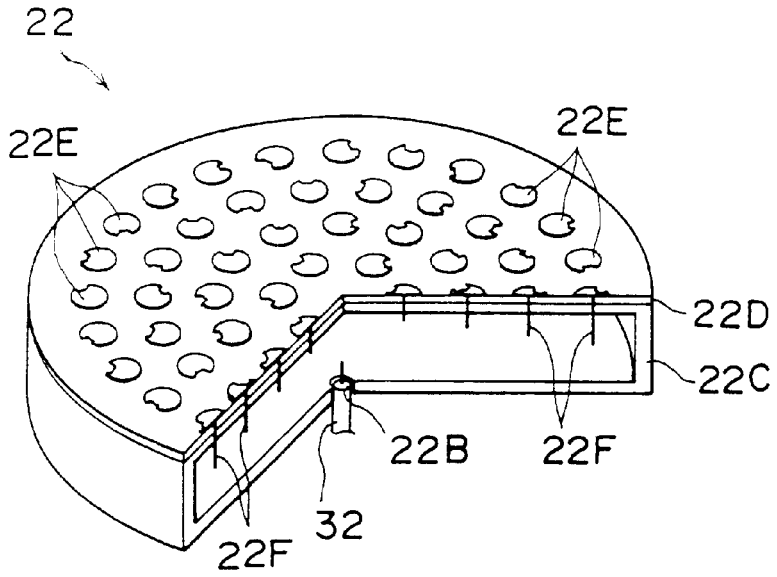
FIG. 4A is a partially fragmentary perspective view of an antenna of the antenna device.

As shown in FIG. 4A, the antenna 22 has a flat radial waveguide 22C made of a metal, and is constructed such that a dielectric layer 22D is formed on the upper surface (the antenna aperture 22A-side surface) of the radial waveguide 22C, and a multiplicity of disk-shaped antenna elements 22E are formed on the upper surface of the dielectric layer 22D. The multiplicity of antenna elements 22E are arranged concentrically with the first rotational axis as a center, and one ends of coupling pins 22F are respectively attached to the multiplicity of antenna elements 22E. The other ends of the coupling pins 22F are passed through the dielectric layer 22D and extend to the interior of the radial waveguide 22C.

When electromagnetic waves arrive at the antenna device 11, the electromagnetic waves which arrived are received by the antenna elements 22E, and the electromagnetic waves received by the antenna elements 22E are synthesized by the radial waveguide 22C. In this embodiment, the angle of relative rotation of the antenna elements 22E is adjusted such that the electromagnetic waves received by the antenna elements 22E assume the same phase and the gain becomes maximum when the direction of arrival of the electromagnetic waves is at an angle at which it is inclined by an angle $\theta_2$ from the direction of the normal line (line a–a' shown in FIGS. 1 and 2) of the antenna aperture 22A which passes the center of the antenna aperture 22A.

Accordingly, the antenna 22 in accordance with this embodiment is formed as a so-called beam tilt antenna in which the range of gain at a predetermined value or higher is narrowed down to a beam shape, and the direction of the antenna beam (the direction in which the gain becomes maximum: the direction of the boresight (the principal axis of directivity) of the antenna 22) is electronically inclined by the angle $\theta_2$ from the direction of the normal line (line a–a' shown in FIGS. 1 and 2) of the antenna aperture 22A which passes the center of the antenna aperture 22A. It should be noted that the angle $\theta_2$ corresponds to a second angle of the present invention.

A second bearing 24 serving as a second rotatably supporting portion is disposed between the antenna supporting base 14 and the antenna 22. The antenna 22 is supported by the antenna supporting base 14 via the second bearing 24 in such a manner as to be rotatable about the normal line of the antenna aperture 22A. The normal line (line a–a') of the antenna aperture 22A which passes the center of the antenna aperture 22A of the antenna 22 corresponds to a second rotational axis of the present invention, and will be hereafter referred to as the "second rotational axis."

Figure 3:
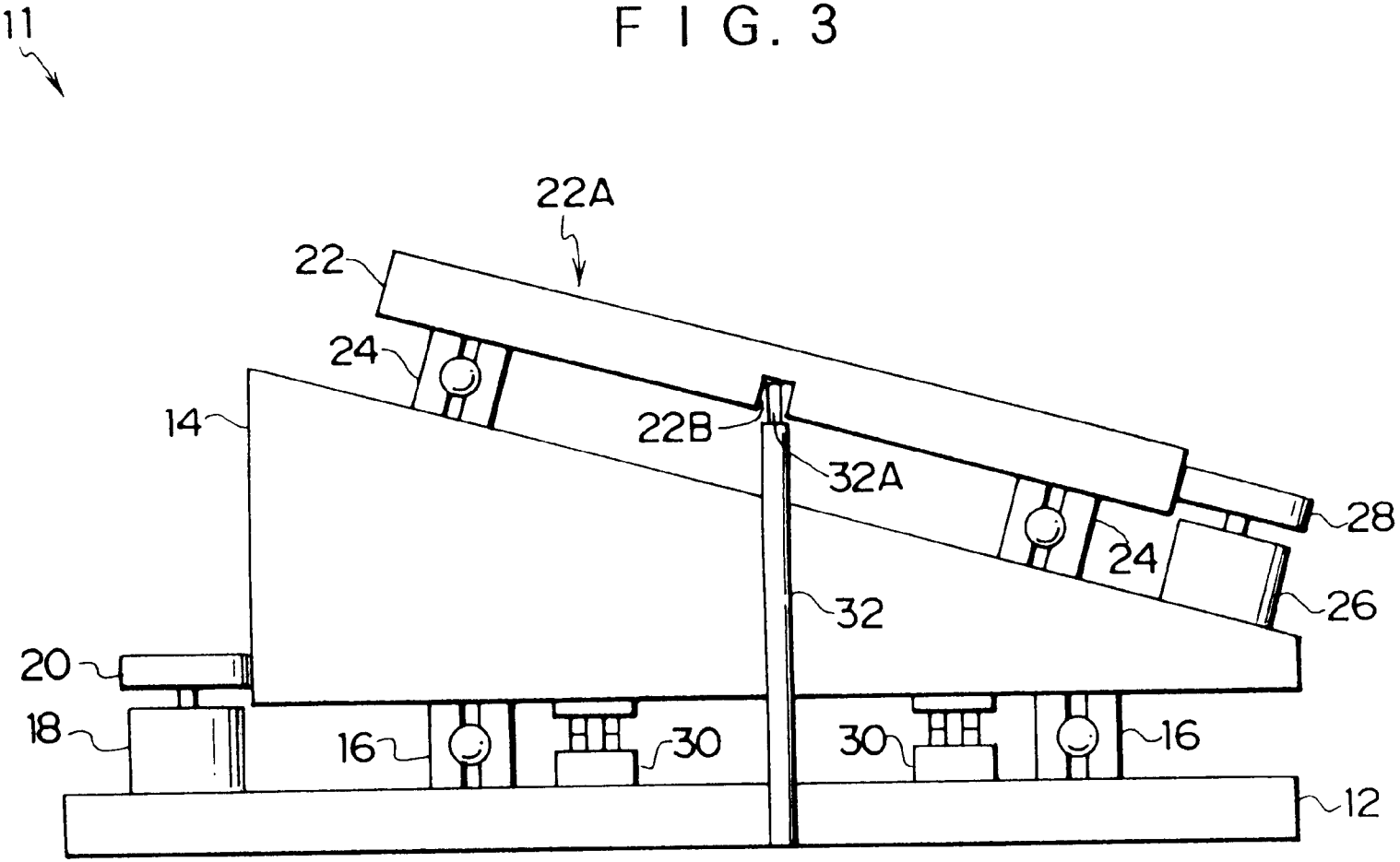
FIG. 3 is a schematic cross-sectional view of the antenna device.

A second motor 26 is disposed on the inclined surface of the antenna supporting base 14. A roller 28, which is formed of a material of a high coefficient of friction such as rubber, is attached to a rotating shaft of the second motor 26. The second motor 26 is disposed on the outer peripheral side of the antenna supporting base 14 such that the roller 28 comes into contact with the peripheral surface of the antenna 22. In addition, as shown in FIGS. 1 and 3, a slip ring 30 is disposed between the base 12 and the antenna supporting base 14 so as to supply electric power to the second motor 26 and transmit a signal outputted from a rotation-angle sensor 48 (which will be described later).

When the second motor 26 is driven as electric power is supplied from an external circuit to the second motor 26 via the slip ring 30, the driving force of the second motor 26 is transmitted to the antenna 22 via the roller 28, with the result that the antenna 22 is rotated about the second rotational axis. The second motor 26 and the roller 28 correspond to a second driving means of the present invention.

Next, a description will be given of the configuration of a control unit and its peripheral components of the directional beam controlling apparatus 10. As shown in FIG. 1, the first motor 18 is connected to an input/output port 40D of a control unit 40 via a driver 36, and the second motor 26 is connected to the input/output port 40D of the control unit 40 via the slip ring 30 and a driver 38. The control unit 40 is comprised of a CPU 40A, a ROM 40B, a RAM 40C, and the input/output port 40D, which are interconnected by means of a bus. The control unit 40 corresponds to a control means of the present invention. The driving of the first motor 18 and the second motor 26 is controlled by the control unit 40 via the drivers 36 and 38, respectively.

A rotation-angle sensor 42 for detecting the angle of rotation of the antenna supporting base 14 with respect to the base 12 is disposed on the base 12. As the rotation-angle sensor 42, it is possible to use, for instance, a rotary encoder or the like which mechanically, optically, or magnetically detects the rotation angle of the antenna supporting base 14 with respect to the base 12, and outputs a pulse signal with a pulse number proportional to the rotation angle. The rotation-angle sensor 42 is connected to the input/output port 40D of the control unit 40 via an amplifier 44 and an A/D converter 46, and the signal representing the rotation angle of the antenna supporting base 14 and outputted from the rotation-angle sensor 42 is amplified by the amplifier 44, is converted into digital data by the A/D converter 46, an is inputted to the control unit 40.

In addition, the rotation-angle sensor 48 for detecting the angle of rotation of the antenna 22 with respect to the antenna supporting base 14 is disposed on the inclined surface of the antenna supporting base 14. As the rotation-angle sensor 48 as well, it is possible to use a rotary encoder or the like. The rotation-angle sensor 48 is connected to the input/output port 40D of the control unit 40 via the slip ring 30, an amplifier 50, and an A/D converter 52, and the signal representing the rotation angle of the antenna 22 and outputted from the rotation-angle sensor 48 is amplified by the amplifier 50, is converted into digital data by the A/D converter 52, an is inputted to the control unit 40.

Figure 4B:
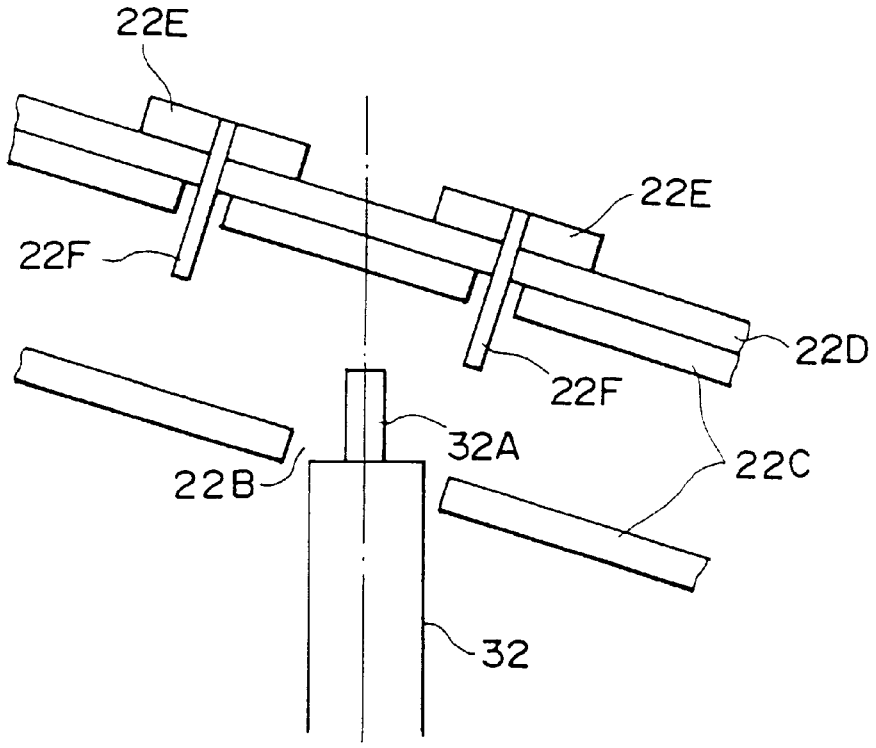
FIG. 4B is a cross-sectional view of a central portion the antenna device and its vicinity.

In addition, in this embodiment, as the antenna 22, the radial waveguide feeding-type antenna is used as described above, and the feeding of the antenna 22 is effected by a configuration which is shown in FIGS. 3 and 4B. Namely, as shown in FIG. 4B, a small hole 22B for feeding the antenna 22 is provided in a central portion of the lower surface of the antenna 22 (the lower surface of the radial waveguide 22C), and a distal end portion of a feed line 32 formed by a coaxial cable or the like is inserted in the small hole 22B.

As shown in FIG. 3, the feed line 32 is attached to the base 12 and is laid along the first rotational axis, and its intermediate portion is passed through holes respectively provided in the perpendicular surface and the inclined surface of the antenna supporting base 14 at a position immediately below the small hole 22B (at a position corresponding to the center of rotation of the antenna supporting base 14). A probe 32A formed by an exposed central conductor of the coaxial cable is inserted in the small hole 22B so as not to come into contact with the inner wall of the small hole 22B. Accordingly, the probe 32A and the coupling pin 22F are coupled with each other via an internal space of the radial waveguide 22C, and the feeding to the antenna 22 is effected on a non-contact basis.

Next, as the operation of this embodiment, a description will be first given of a change in the direction of the antenna beam by changing the angle of rotation of the antenna 22 with respect to the antenna supporting base 14 as well as the angle of rotation of the antenna supporting base 14 with respect to the base 12.

Figure 5B:
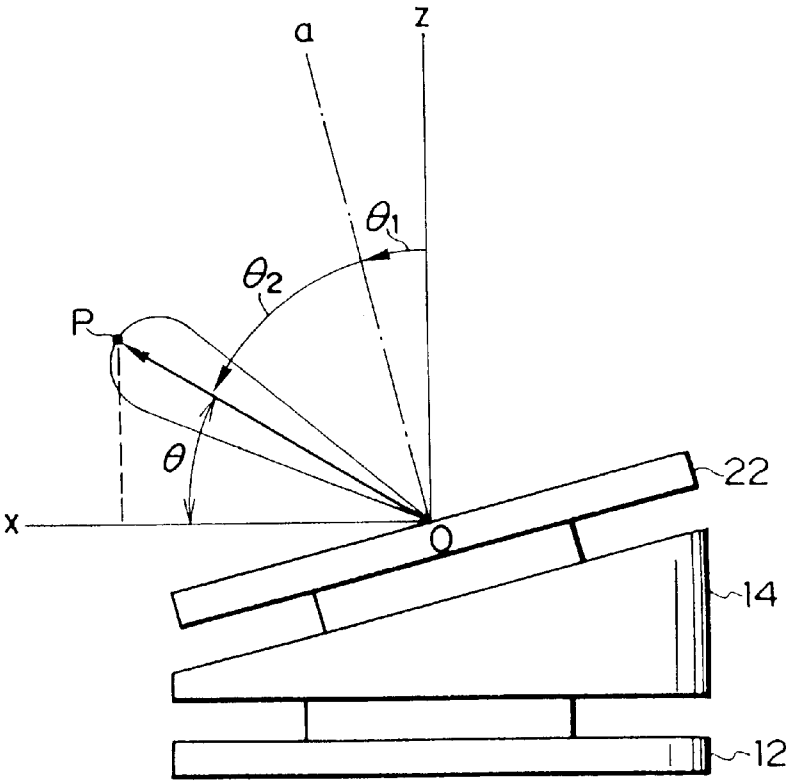
FIG. 5B is a side elevational view of the antenna device for explaining the change in the elevation angle $\theta$ of the antenna beam due to the rotation of the antenna and the antenna supporting base.
Figure 5A:
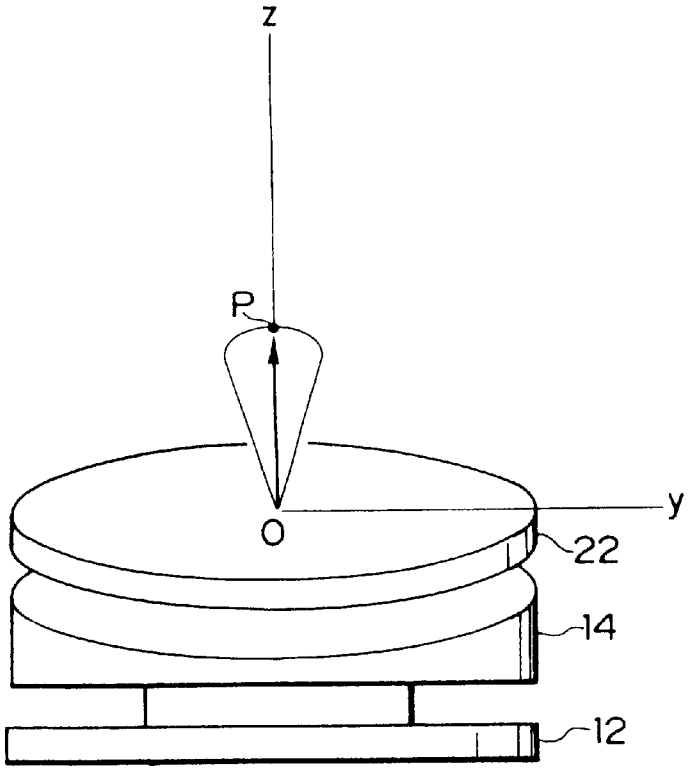
FIG. 5A is a front elevational view of the antenna device for explaining a change in the elevation angle $\theta$ of an antenna beam due to the rotation of the antenna and an antenna supporting base.
Figure 6:
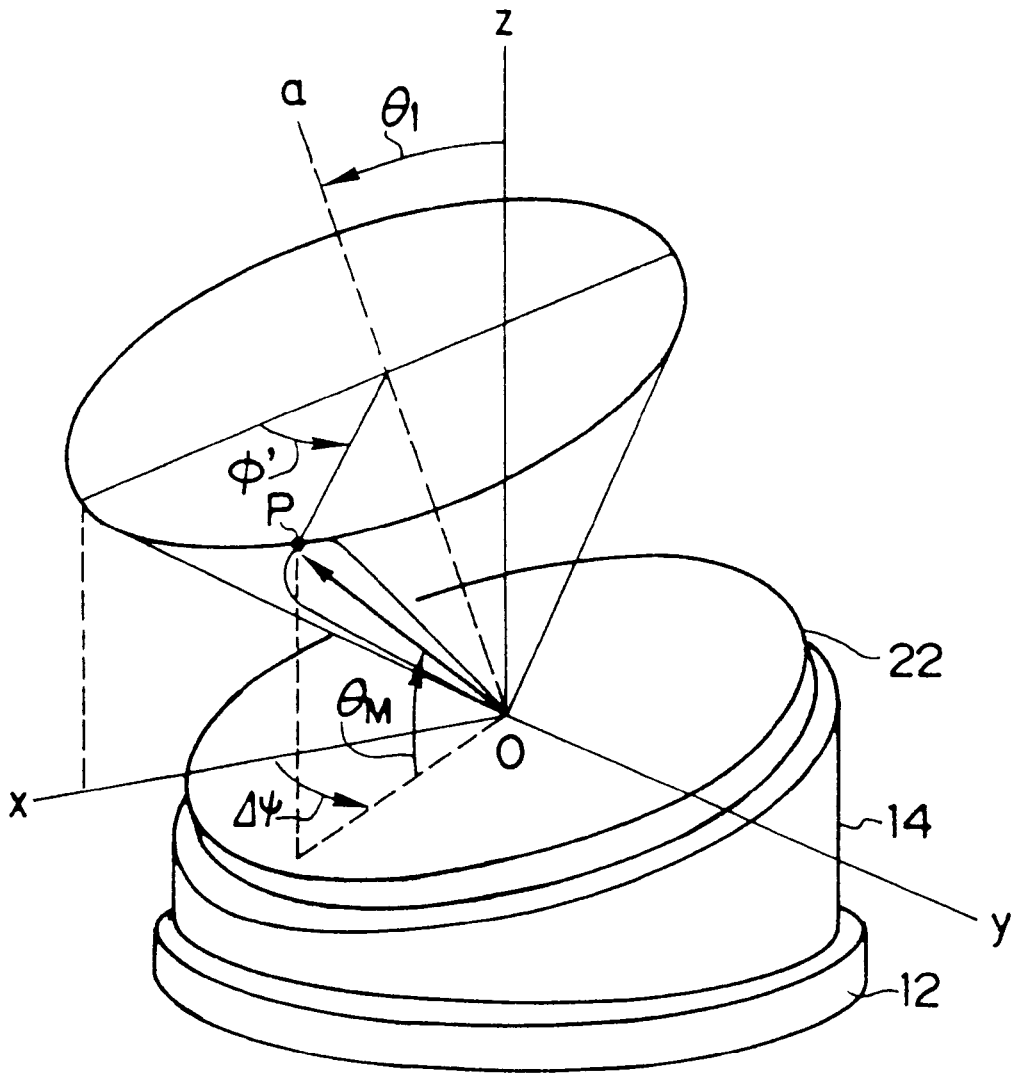
FIG. 6 is a perspective view of the antenna device for explaining the change in the elevation angle $\theta$ of the antenna beam due to the rotation of the antenna and the antenna supporting base.

The antenna device 11 of the directional beam controlling apparatus 10 in accordance with this embodiment is arranged such that the upper surface of the base 12 becomes substantially horizontal. With respect to the antenna device 11 thus arranged, as shown in FIGS. 5A, 5B, and 6, the origin 0 of coordinates is set at the center of the antenna 22, the x-y plane is set in such a manner as to be parallel with the base 12, and the z-x plane is set in such a manner as to include the second rotational axis a-O of the antenna 22. It should be noted that the point P represents a point where the gain becomes maximum, and the direction from the origin O of coordinates toward the point P is the direction of the antenna beam. In FIGS. 5A and 5B, the azimuth angle $\phi$ of the antenna beam coincides with the positive direction of the x-axis, and shows the state in which the elevation angle of the antenna beam with respect to the base 12 becomes the smallest (i.e., the state in which the elevation angle $\theta$ becomes $\pi/2-(\theta_1+\theta_2)$). Hereafter, this state will be referred to as a reference state.

FIG. 6 shows the direction of the antenna beam at a time when the antenna 22 is rotated about the second rotational axis a-O at a rotation angle $\phi'$ from the reference state. It can be appreciated from FIG. 6 that the elevation angle of the antenna beam can be changed by rotating the antenna 22 with respect to the antenna supporting base 14. The elevation angle $\theta$ of the antenna beam at this time can be expressed by the following Formula (1):

$$\theta=\pi/2-\cos^{-1}(\cos\theta_1\cos\theta_2-\sin\theta_1\sin\theta_2\cos\phi') \text{ (where } 0\leq\phi'\leq\pi/2) \quad (1)$$

Figure 7:
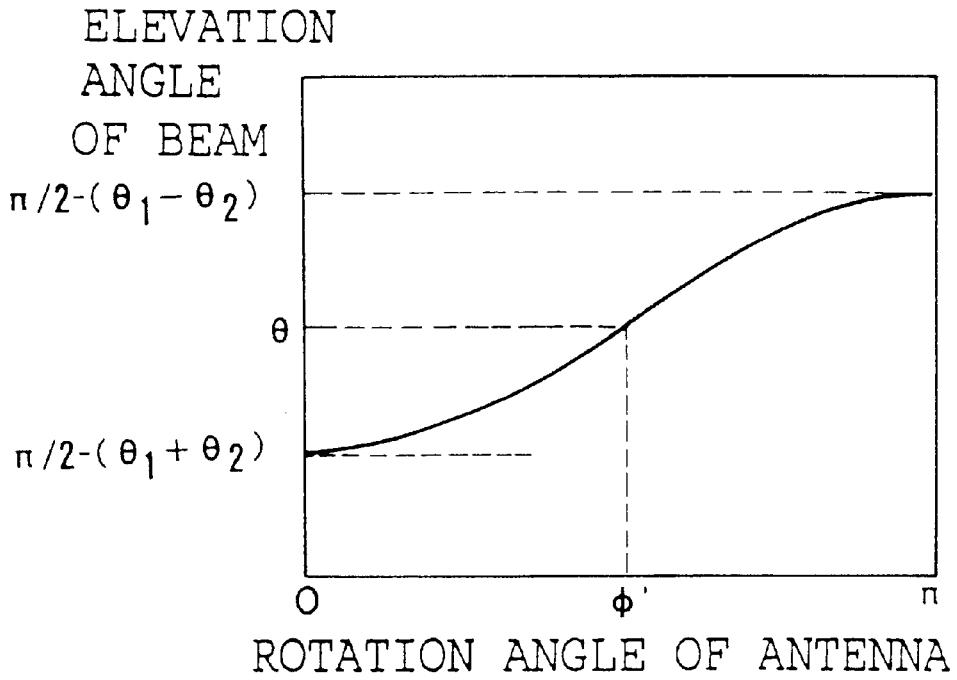
FIG. 7 is a diagram illustrating the change in the elevation angle $\theta$ of the antenna beam with respect to a change in a rotation angle $\phi'$ of the antenna.

FIG. 7 shows a change in the elevation angle $\theta$ of the antenna beam with respect to the change in the rotation angle $\phi'$ of the antenna 22 from the reference state. As is apparent from FIG. 7, by changing the rotation angle $\phi'$ of the antenna 22 about the second rotational axis a-O in the range of 0 to $\pi$ from the reference state, the elevation angle $\theta$ of the antenna beam can be changed monotonously from $\pi/2-(\theta_1+\theta_2)$ to $\pi/2-(\theta_1-\theta_2)$.

Accordingly, it can be appreciated that, to control the elevation angle $\theta$ of the antenna beam to a desired angle $\theta_M$, it suffices if the antenna 22 is rotated about the second rotational axis a-O from the reference state with respect to the antenna supporting base 14 at the rotation angle $\phi'$ which is expressed by the following Formula (2):

$$\phi' = \cos^{-1}\left(\frac{\cos\theta_1\cos\theta_2-\sin\theta_M}{\sin\theta_1\sin\theta_2}\right) \quad (2)$$

However, if the antenna 22 is rotated about the second rotational axis a-O from the reference state with respect to the antenna supporting base 14 at the rotation angle $\phi'$, not only the elevation angle $\theta$ of the antenna beam but also the azimuth angle $\phi$ of the antenna beam changes. In this case, the amount of change, $\Delta\phi$, in the azimuth angle of the antenna beam can be expressed by the following Formula (3):

$$\Delta\varphi = \begin{cases} \tan^{-1}\left(\dfrac{\sin\theta_2 \sin\phi'}{\sin\theta_1 \cos\theta_2 + \cos\theta_1 \sin\theta_2 \cos\phi'}\right) \\ \left[\text{where } 0 \le \phi' < \cos^{-1}\left(-\dfrac{\tan\theta_1}{\tan\theta_2}\right)\right] \\ \pi + \tan^{-1}\left(\dfrac{\sin\theta_2 \sin\phi'}{\sin\theta_1 \cos\theta_2 + \cos\theta_1 \sin\theta_2 \cos\phi'}\right) \\ \left[\text{where } \cos^{-1}\left(-\dfrac{\tan\theta_1}{\tan\theta_2}\right) < \phi' \le \pi\right] \\ \dfrac{\pi}{2} \left[\text{where } \phi' = \cos^{-1}\left(-\dfrac{\tan\theta_1}{\tan\theta_2}\right)\right] \end{cases} \quad (3)$$

Figure 8:
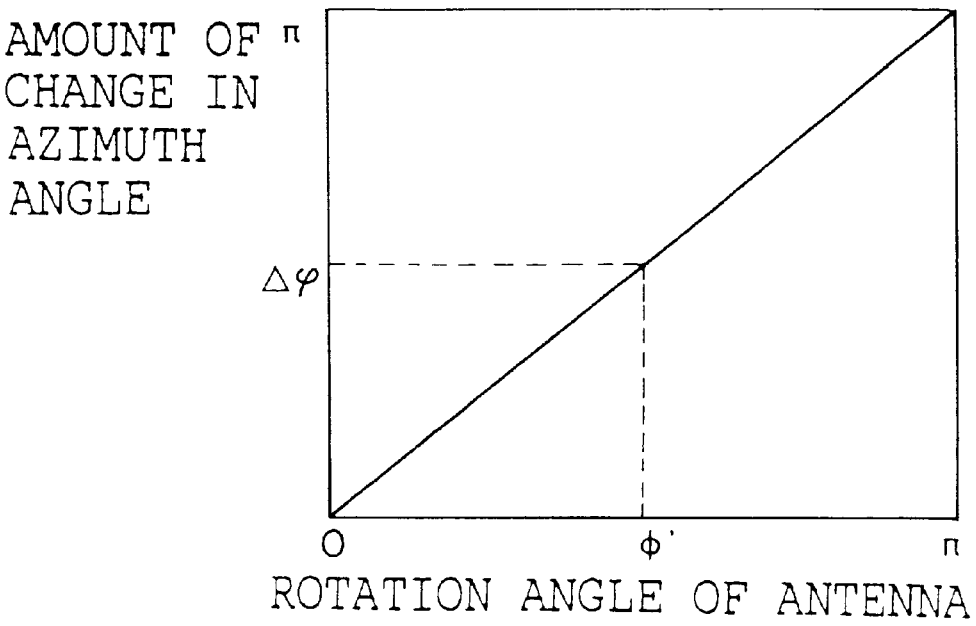
FIG. 8 is a diagram illustrating the amount of change, $\Delta\phi$, in the azimuth angle of the antenna beam with respect to the change in the rotation angle $\phi'$ of the antenna.

The amount of change, $\Delta\phi$, in the azimuth angle of the antenna beam when the antenna 22 is rotated from the reference state at the rotation angle $\phi'$ with respect to the antenna supporting base 14 changes monotonously, as shown in FIG. 8.

Accordingly, after the antenna 22 is rotated by the second motor 26 with respect to the antenna supporting base 14 from the reference state at the rotation angle $\phi'$ which is expressed by Formula (2), the antenna supporting base 14 is rotated by the first motor 18 at a rotation angle $-\Delta\phi$ with respect to the base 12 in such a manner as to cancel the change in the azimuth angle $\phi$ of the antenna beam (i.e., the amount of change, $\Delta\phi$, in the azimuth angle expressed by Formula (3)) occurring by accompanying the rotation of the antenna 22. As a result, it is possible to control the changing of only the elevation angle $\theta$ of the antenna beam to the desired angle $\theta_M$ without changing the azimuth angle $\phi$ of the antenna beam. In addition, it goes without saying that it is possible to control the changing of the azimuth angle $\phi$ of the antenna beam to the desired azimuth angle $\phi_M$ by rotating the antenna supporting base 14 with respect to the base 12 by means of the first motor 18.

Next, referring to the flowcharts shown in FIGS. 9A and 9B, a description will be given of beam-direction control processing for setting the direction of the antenna beam to a desired elevation angle (target elevation angle $\theta_M$) and to a desired azimuth angle (target azimuth angle $\phi_M$), the processing being started by the CPU 40A of the control unit 40 when power is turned on or the apparatus is reset.

In Step 100, the antenna 22 is first rotated by the second motor 26 with respect to the antenna supporting base 14 while monitoring the rotation angle $\phi'$ of the antenna 22 detected by the rotation-angle sensor 48, and the antenna supporting base 14 is then rotated by the first motor 18 with respect to the base 12 while monitoring the rotation angle $\phi'$ of the antenna supporting base 14 detected by the rotation-angle sensor 42, such that the antenna 22 and the antenna supporting base 14 are set in the above-described reference state. In Step 102, the present angle $\phi_0$ of the antenna 22, the present angle $\phi_0$ of the antenna supporting base 14, and the amount of change, $\Delta\phi_0$, in the azimuth angle of the antenna beam at the present angle of the antenna 22 are reset (cleared to 0).

In an ensuing Step 104, the target angle $\phi_M$ of the antenna 22 (i.e., the rotation angle $\phi'$ from the reference state in Formula (2)) at a time when the elevation angle $\theta$ of the antenna beam becomes a predetermined target elevation angle $\theta_M$ is calculated. In Step 106, the rotation angle $\phi'_M$ of the antenna 22 for setting the present angle $\phi_0$ of the antenna 22 to the target angle $\phi_M$ is calculated in accordance with the following formula:

$$\phi'_M = \phi_M - \phi_0$$

If the antenna 22 is rotated at the rotation angle $\phi'_M$ which is determined by the above Formula, the elevation angle $\theta$ of the antenna beam can be made to agree with the target elevation angle $\theta_M$. However, if the antenna 22 is rotated, the azimuth angle $\phi$ of the antenna beam also changes as described before. For this reason, in an ensuing Step 108, the amount of change, $\Delta\phi_M$, in the azimuth angle of the antenna beam ($\Delta\phi$ in Formula (3)) at a time when the angle $\phi$ of the antenna 22 is the target angle $\phi_M$ is calculated in accordance with Formula (3). In Step 110, the difference $\Delta\phi'_M$ in the amount of change in the azimuth angle of the antenna beam at a time when the antenna 22 is rotated from the present angle $\phi_0$ to the target angle $\phi_M$ is calculated in accordance with the following formula:

$$\Delta\phi'_M \Delta\phi_M - \Delta\phi_0$$

In Step 112, by taking into consideration the change in the azimuth angle of the antenna beam which accompanies the rotation of the antenna 22, the rotation angle $\phi'_M$ from the present angle $\phi_0$ of the antenna supporting base 14 for setting the azimuth angle $\phi$ of the antenna beam to the target azimuth angle $\phi_M$ on the basis of the predetermined target azimuth angle $\phi_M$ of the antenna beam is calculated in accordance with the following formula:

$$\phi'_M = \phi_M - \phi_0 - \Delta\phi'_M$$

In Step 114, the antenna 22 is rotated by the second motor 26 at the rotation angle $\phi'_M$ with respect to the antenna supporting base 14 while monitoring the rotation angle $\phi'$ of the antenna 22 detected by the rotation-angle sensor 48. In an ensuing Step 116, the antenna supporting base 14 is rotated by the first motor 18 by the rotation angle $\phi'_M$ with respect to the base 12 while monitoring the rotation angle $\phi'$ of the antenna supporting base 14 detected by the rotation-angle sensor 42. As a result, the elevation angle $\theta$ of the antenna beam agrees with the target elevation angle $\theta_M$ and the azimuth angle $\phi$ of the antenna beam agrees with the target azimuth angle $\phi_M$.

In an ensuing Step 118, the target angle $\phi_M$ of the antenna 22 determined in Step 104 is substituted for the present angle $\phi_0$, a value in which the rotation angle $\phi'_M$ determined in Step 112 is added to the present angle $\phi_0$ is substituted for the present angle $\phi_0$ of the antenna supporting base 14, and the amount of change, $\Delta\phi_M$, in the azimuth angle determined in Step 108 is substituted for the amount of change, $\Delta\phi_0$, in the azimuth angle of the antenna beam at the present angle of the antenna 22, thereby updating the values of the respective variables.

In an ensuing Step 120, a determination is made as to whether or not the above-described control of the direction of the antenna beam is to be continued. If YES is the answer in the determination, the operation returns to Step 104 to repeat the processing in and after Step 104. As a result, in a case where the target elevation angle $\theta_M$ and the target azimuth angle $\phi_M$ of the antenna beam are consecutively changed, the angles of the antenna 22 and the antenna supporting base 14 are respectively controlled such that the elevation angle $\theta$ of the antenna beam agrees with the target elevation angle $\theta_M$, and the azimuth angle $\phi$ of the antenna beam agrees with the target azimuth angle $\phi_M$. In addition, if NO is the answer in the determination in Step 120, the beam-direction control processing ends.

By virtue of the above-described beam-direction control processing, it is possible to control the changing of the elevation angle $\theta$ and the azimuth angle $\phi$ of the antenna beam to desired angles (the target elevation angle $\theta_M$ and the target azimuth angle $\phi_M$). In addition, with the directional beam controlling apparatus 10 in accordance with this embodiment, the amount of change in the elevation angle θ of the antenna beam when the angle ϕ of the antenna 22 has changed in the range of 0 to π is $2\theta_2$, and since $\theta_2<\pi/2$, the change in the elevation angle θ of the antenna beam is relatively small in comparison with the change in the angle ϕ of the antenna 22. Accordingly, it is possible to improve the controlling accuracy at the time when the antenna 22 is rotated for controlling the elevation angle θ of the antenna beam to a desired angle.

In addition, in the above-described embodiment, the antenna 22 is arranged parallel to the inclination of the inclined surface of the antenna supporting base 14, and the antenna 22 is supported by the antenna supporting base 14 by means of the second bearing 24, so that the angle of inclination of the antenna aperture 22A of the antenna 22 is always held at the angle $\theta_1$ irrespective of its rotation angle. Accordingly, it is possible to reliably suppress the variation in the elevation angle θ of the antenna beam in a case where a disturbance such as vibration is applied.

In addition, in the above-described embodiment, the arrangement provided is such that the rotation of the antenna supporting base 14 is supported by the first bearing 16, and the rotation of the antenna 22 is supported by the second bearing 24, so that it is possible to reduce the frictional resistance which occurs due to the rotation of the antenna supporting base 14 and the antenna 22. Accordingly, since compact lightweight motors which generate relatively small torque can be used as the first motor 18 and the second motor 26, it is possible to realize a compact and lightweight antenna device 11.

In addition, in the above-described embodiment, since the first motor 18 and the roller 20 for rotating the antenna supporting base 14 are disposed on the base 12, the portion which is rotated by the first motor 18 (i.e., the portion including the antenna supporting base 14 and the antenna 22) can be made lightweight. Accordingly, since a compact lightweight motor which generates relatively small torque can be used as the first motor 18, it is possible to realize a more compact and lightweight antenna device 11.

In addition, in the above-described embodiment, since the feeding to the antenna 22 is effected on a non-contact basis by using the feed line 32 provided on the base 12, deterioration over time due to wear or the like does not occur, and it is possible to prevent a decline over time in the communication performance of the directional beam controlling apparatus 10.

Incidentally, instead of the rotation-angle sensors 42 and 48, limit switches or the like may be provided for detecting whether the angle of the antenna supporting base 14 about the first rotational axis with respect to the base 12, as well as the angle of the antenna 22 about the second rotational axis with respect to the antenna supporting base 14, are specific angles (e.g., angles corresponding to the reference state), and stepping motors may be used as the first motor 18 and the second motor 26, respectively.

The stepping motor is a motor whose rotating shaft rotates by a rotation angle proportional to the pulse number of an inputted drive pulse signal. After it is detected by the limit switch that the angle of the antenna supporting base 14 or the antenna 22 has reached the specific angle corresponding to the reference state, the number of pulses of the drive pulse signal supplied to the stepping motor is counted (counted up or counted down) in correspondence with the rotating direction of the rotating shaft of the stepping motor. As a result, the control unit 40 can constantly detect the angle of the antenna supporting base 14 about the first rotational axis with respect to the base 12 and the angle of the antenna 22 about the second rotational axis with respect to the antenna supporting base 14.

Figure 9A:
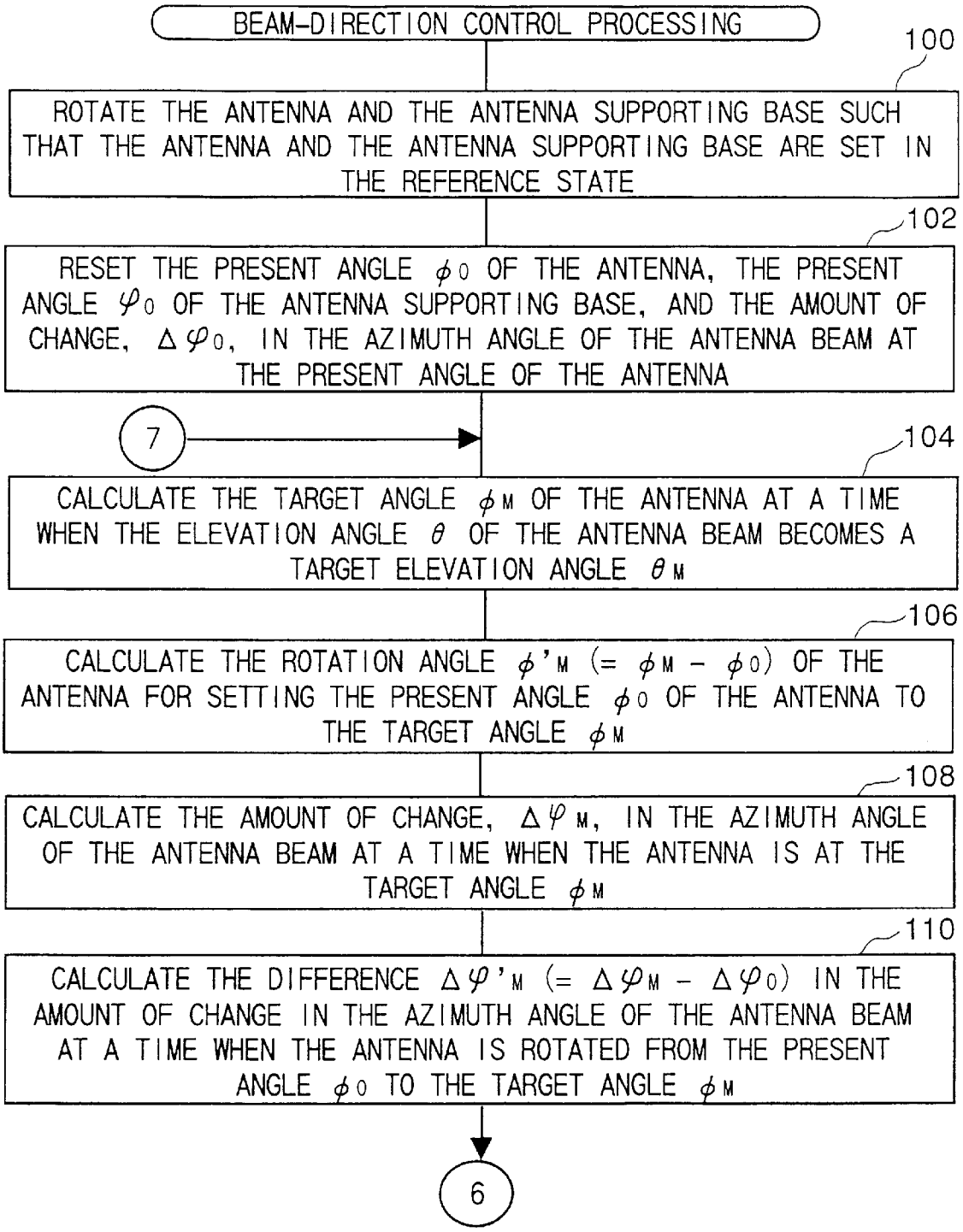
FIGS. 9A and 9B are flowcharts illustrating beam-direction control processing in accordance with the first embodiment.
Figure 9B:
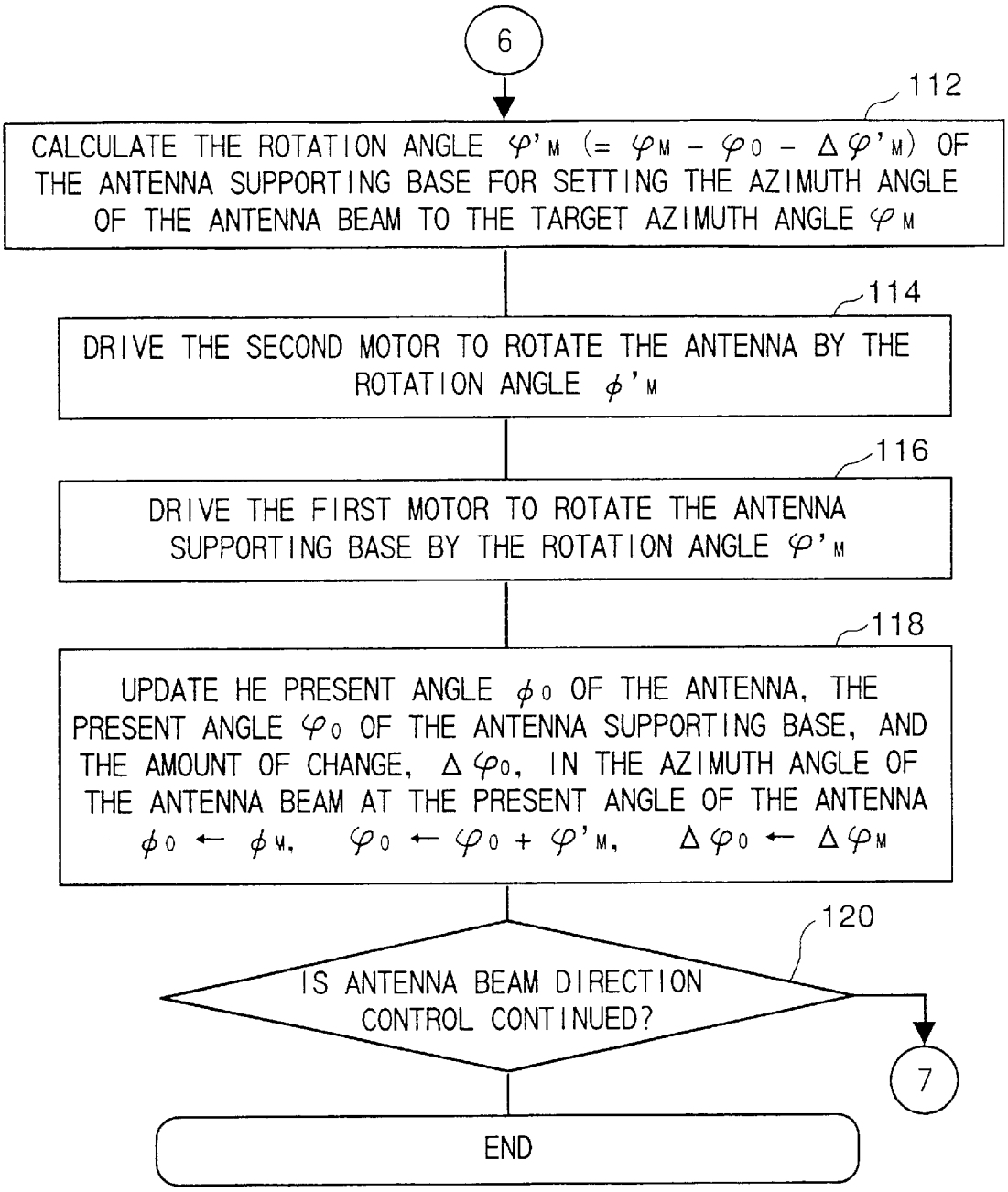

In addition, in the beam-direction control processing shown in FIGS. 9A and 9B, the arrangement provided is such that the antenna 22 is rotated with respect to the antenna supporting base 14 by the rotation angle $\phi'_M$ determined by the calculation, and the antenna supporting base 14 is rotated with respect to the base 12 by the rotation angle $\phi'_M$ determined by the calculation, so as to direct the antenna beam in the desired direction. Depending on the structure and the like for rotatably supporting the antenna 22, however, if the antenna supporting base 14 is rotated, there are cases where the antenna 22 relatively rotates with respect to the antenna supporting base 14, thereby causing the elevation and azimuth angles of the antenna beam to be slightly offset from desired angles.

Figure 10A:
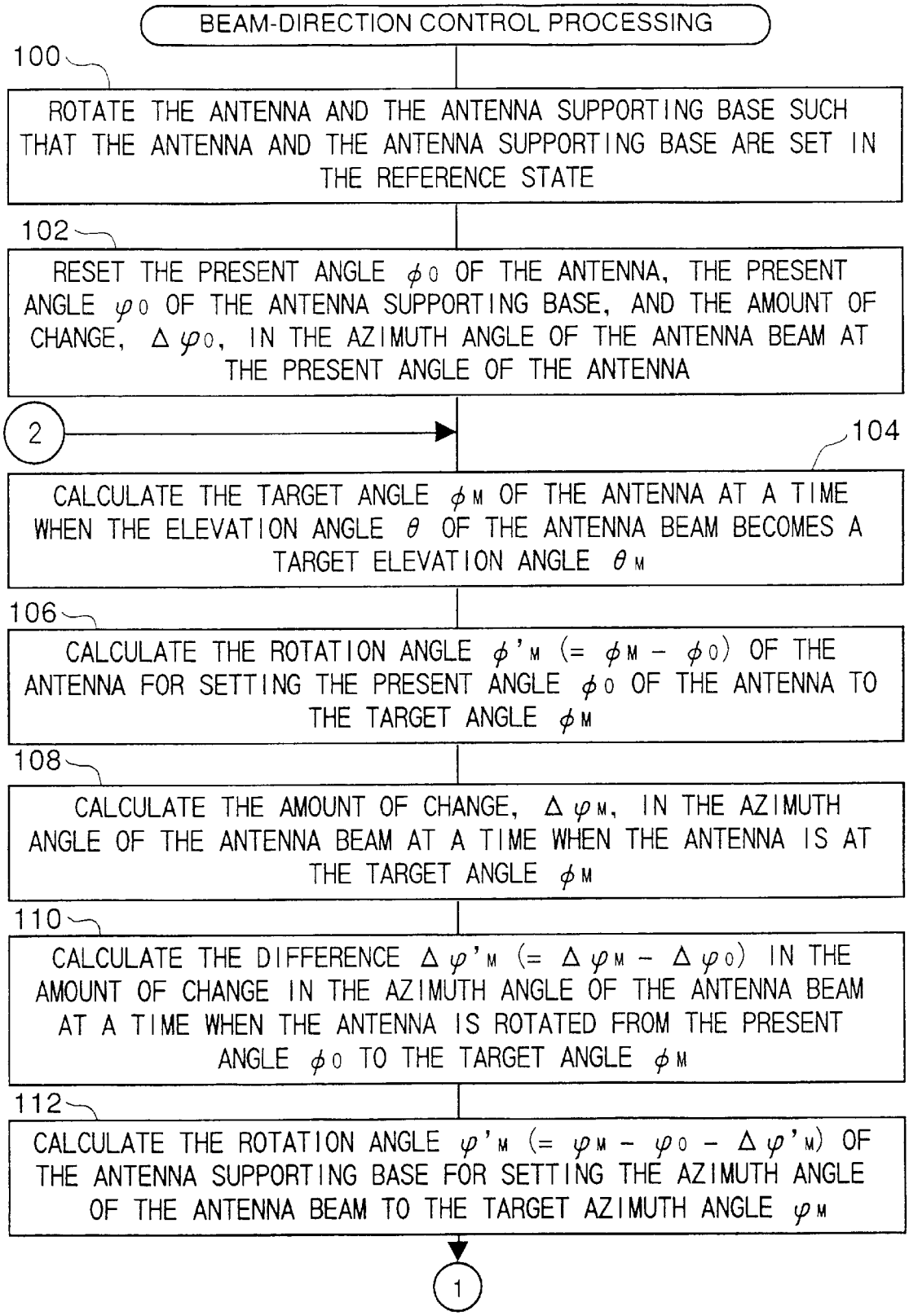
FIGS. 10A and 10B are flowcharts illustrating another example of the beam-direction control processing.
Figure 10B:
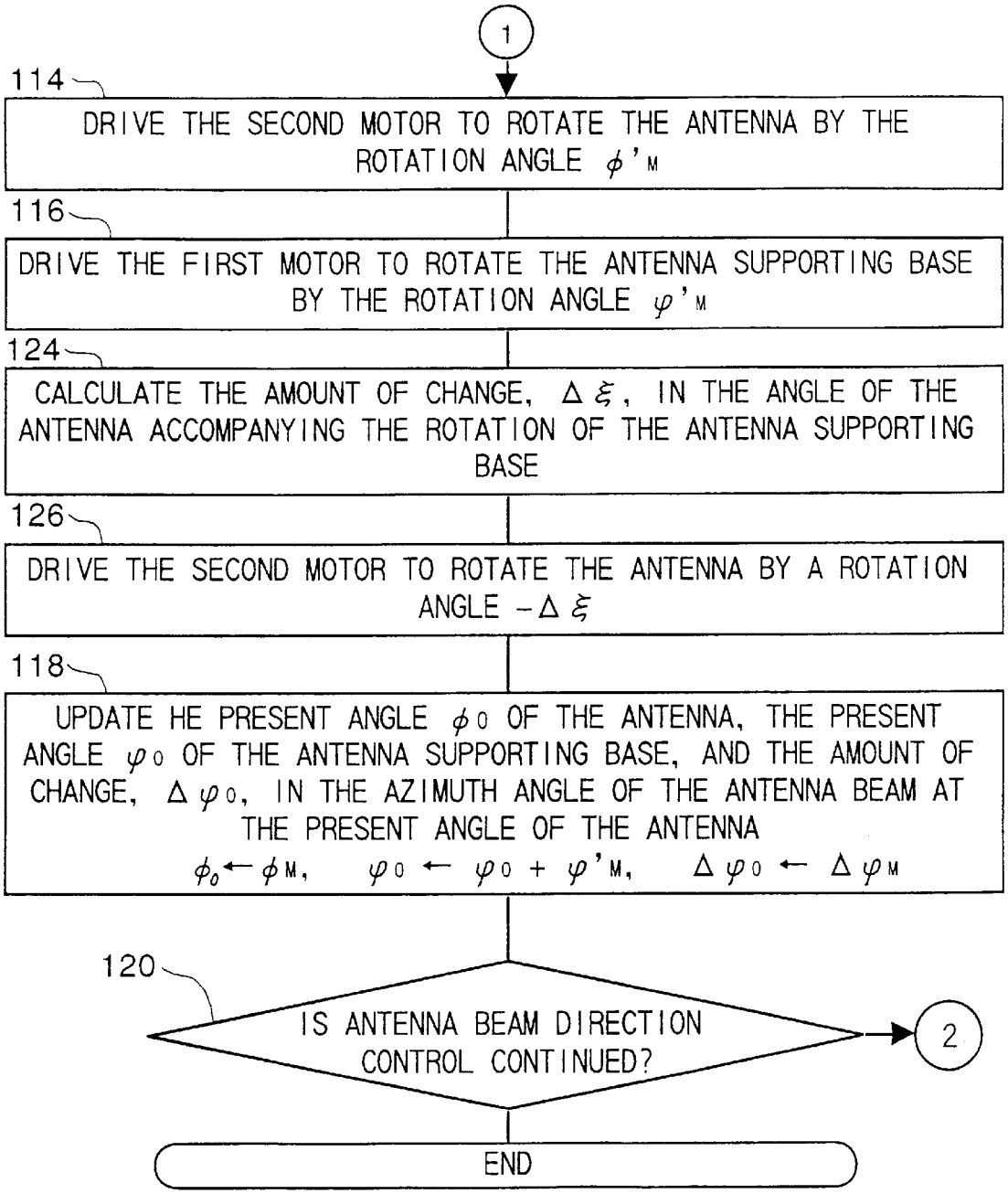

By taking this aspect into consideration, the beam-direction control processing may be effected as shown in FIGS. 10A and 10B. It should be noted that, in FIGS. 10A and 10B, the steps which overlap with those of the beam-direction control processing shown in FIGS. 9A and 9B will be denoted by the same step numbers, and a description thereof will be omitted.

In the beam-direction control processing shown in FIGS. 10A and 10B, after the antenna supporting base 14 is rotated by the rotation angle $\phi'_M$ in Step 116, the amount of change (the angle of relative rotation with respect to the antenna supporting base 14), Δξ, in the angle of the antenna 22 accompanying the rotation of the antenna supporting base 14 is calculated in an ensuing Step 124 on the basis of the rotation angle ϕ' of the antenna 22 detected by the rotation-angle sensor 48. Then in an ensuing Step 126, the antenna 22 is rotated by the second motor 26 by a rotation angle −Δξ with respect to the antenna supporting base 14 while monitoring the rotation angle ϕ' of the antenna 22 detected by the rotation-angle sensor 48.

Consequently, even if the antenna 22 undergoes relative rotation with respect to the antenna supporting base 14 by accompanying the rotation of the antenna supporting base 14 with respect to the base 12, the elevation and azimuth angles of the antenna beam can be reliably controlled to desired angles, and the accuracy in controlling the elevation and azimuth angles of the antenna beam improves.

It should be noted that an ultrasonic motor may be used as the second motor 26. Since the ultrasonic motor generally has high holding torque when it is not being driven, it is possible to suppress the antenna 22 from rotating with respect to the antenna supporting base 14 even if the antenna supporting base 14 is rotated with respect to the base 12, so that it becomes unnecessary to effect the processing of the above-described Steps 124 and 126.

Second Embodiment

Next, a description will be given of a second embodiment of the present invention. It should be noted that those portions that are identical to those of the first embodiment will be denoted by the same reference numerals, and a description thereof will be omitted.

Figure 11:
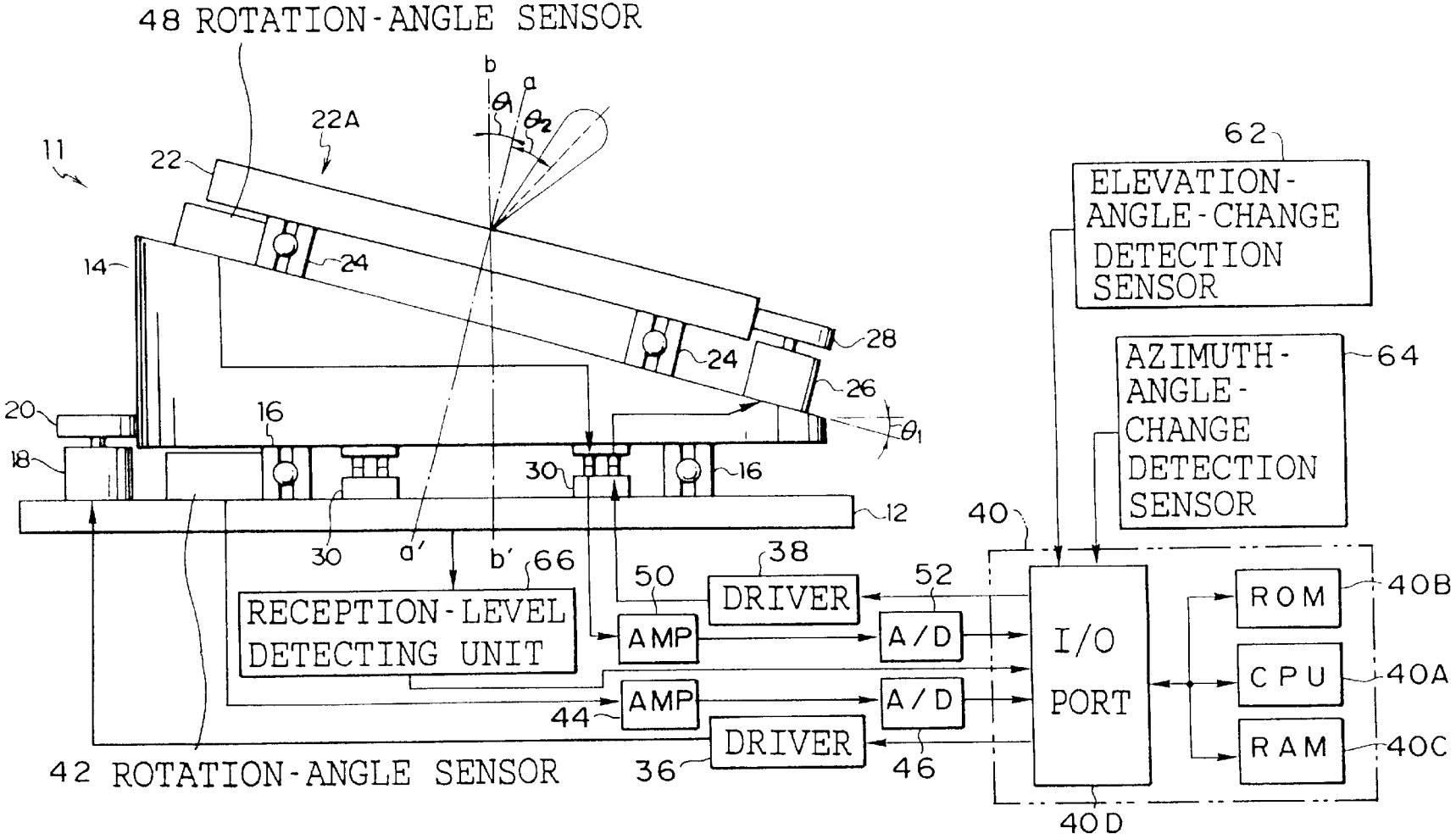
FIG. 11 is a schematic diagram of a directional beam controlling apparatus in accordance with a second embodiment.

FIG. 11 shows a directional beam controlling apparatus 60 in accordance with the second embodiment. It is assumed that this directional beam controlling apparatus 60 is mounted in a mobile object such as a vehicle and effects communication by making use of a satellite. The directional beam controlling apparatus 60 has an elevation-angle-change detection sensor 62 for detecting a change in the attitude in the direction of the elevation angle of the mobile object in which the directional beam controlling apparatus 60 is mounted, as well as an azimuth-angle-change detection sensor 64 for detecting a change in the attitude in the direction of the azimuth angle of the mobile object. The elevation-angle-change detection sensor 62 and the azimuth-angle-change detection sensor 64 are connected to the input/output port 40D of the control unit 40, and the results of detection by the sensors 62 and 64 are inputted to the control unit 40.

In addition, a receiving level detecting unit 66 is connected to the input/output port 40D of the control unit 40. Although the illustration is not given, the receiving level detecting unit 66 is connected to the feed line 32 (see FIG. 3), detects the signal intensity (receiving level) of the electrical signal outputted from the antenna 22 on reception by the antenna 22 of a electromagnetic wave arrived from the satellite (e.g., a beacon wave or the like), and outputs the result of detection to the control unit 40.

Figure 12A:
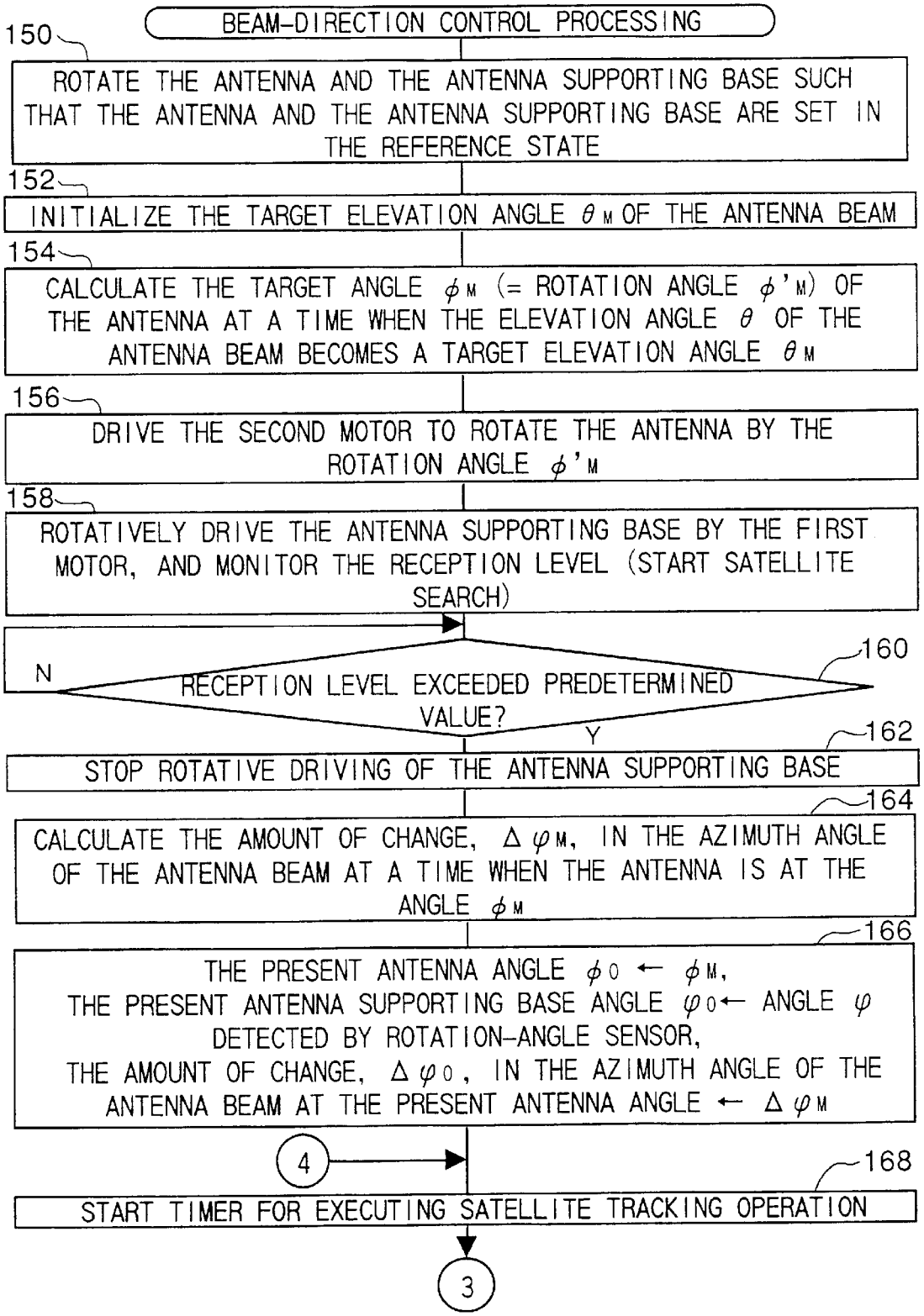
FIGS. 12A to 12C are flowcharts illustrating beam-direction control processing in accordance with the second embodiment.
Figure 12B:
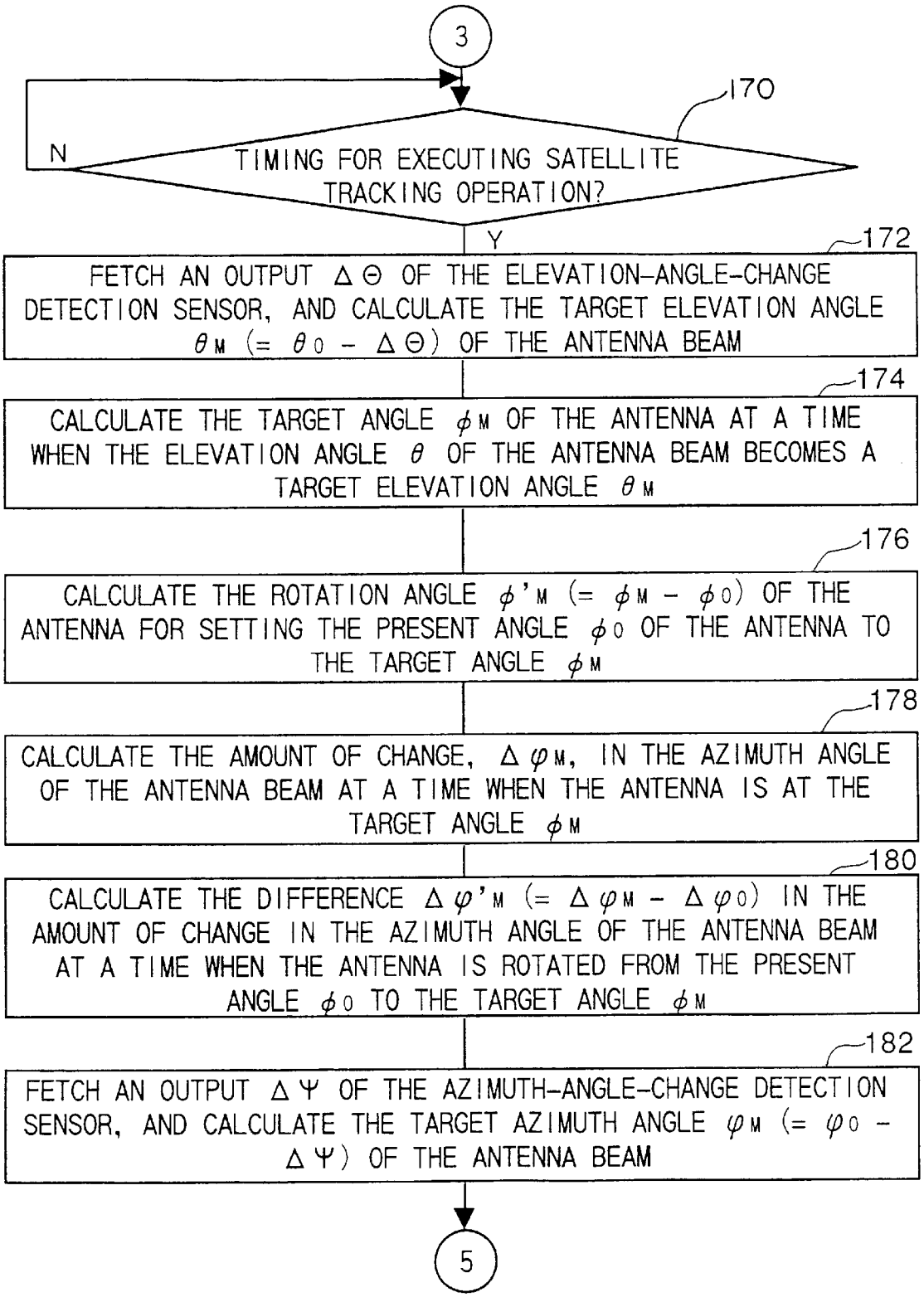
Figure 12C:
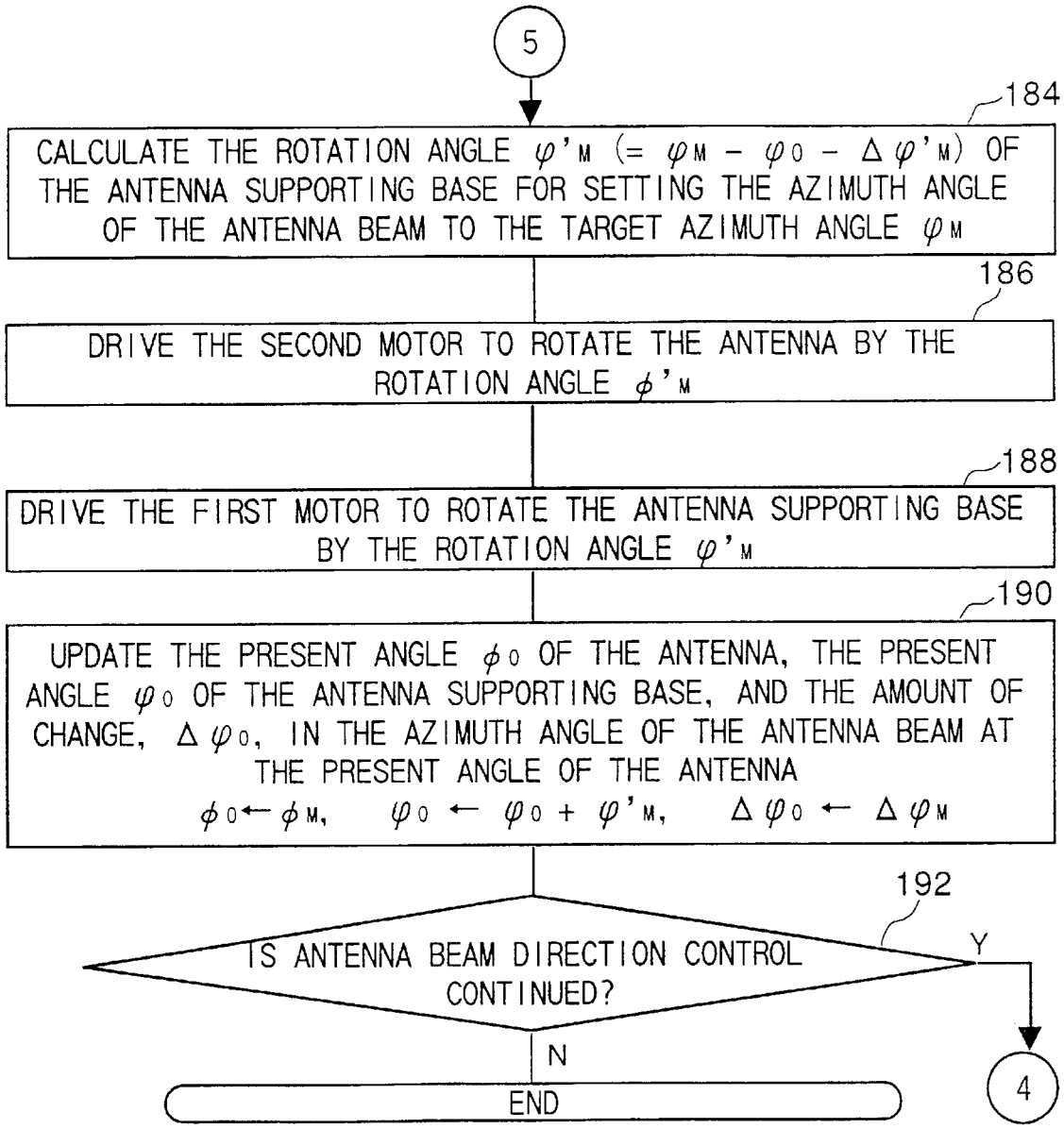

Next, referring to the flowcharts shown in FIGS. 12A to 12C, a description will be given of the beam-direction control processing executed by the CPU 40A of the control unit 40 of the directional beam controlling apparatus 60 in accordance with the second embodiment. It should be noted that, in Steps 150 to 166 in the beam-direction control processing, the initial acquisition operation is effected in which the antenna beam is oriented toward a satellite subject to orientation. This initial acquisition operation is carried out immediately when the power is tuned on or the apparatus is reset. The initial acquisition operation is effected in a state in which the base 12 of the antenna device 11 is substantially horizontal and the first rotational axis extends substantially along the vertical direction.

In Step 150, the antenna 22 is first rotated by the second motor 26 with respect to the antenna supporting base 14 while monitoring the rotation angle $\phi'$ of the antenna 22 detected by the rotation-angle sensor 48, and the antenna supporting base 14 is then rotated by the first motor 18 with respect to the base 12 while monitoring the rotation angle $\phi'$ of the antenna supporting base 14 detected by the rotation-angle sensor 42, such that the antenna 22 and the antenna supporting base 14 are set in the above-described reference state. In Step 152, in a case where the elevation angle of the satellite is already known, that value is set as the target elevation angle $\theta_M$ of the antenna beam, whereas if the elevation angle of the satellite is not known, a value stored in advance in the ROM 40C or the like is set as the target elevation angle $\theta_M$ of the antenna beam, thereby initializing the target elevation angle $\theta_M$.

In Step 154, the target angle $\phi_M$ of the antenna 22 at a time when the elevation angle $\theta$ of the antenna beam becomes a target elevation angle $\theta_M$ is calculated in accordance with Formula (2). Incidentally, at this time, since the antenna 22 (and the antenna supporting base 14) is set in the reference state in the earlier Step 150, the target angle $\phi_M$ calculated above agrees with the rotation angle $\phi'_M$ of the antenna 22 for setting the elevation angle $\theta$ of the antenna beam to the target elevation angle $\theta_M$. Then, in an ensuing Step 156, the antenna 22 is rotated by the second motor 26 by the rotation angle $\phi'_M$ ($=\phi_M$) with respect to the antenna supporting base 14 while monitoring the rotation angle $\phi'$ of the antenna 22 detected by the rotation-angle sensor 48. As a result, the elevation angle $\theta$ of the antenna beam agrees with the target elevation angle $\theta_M$.

In Step 158, the antenna supporting base 14 is rotated at a fixed speed with respect to the base 12 by the first motor 18 to consecutively change the azimuth angle of the antenna beam, and the searching of the satellite is started while monitoring the receiving level detected by the receiving level detecting unit 66. In an ensuing Step 160, a determination is made as to whether or not the receiving level detected by the receiving level detecting unit 66 has exceeded a predetermined value, and the operation waits until YES is given as the answer in the determination.

If the receiving level has exceeded the predetermined value, it can be judged that the azimuth angle of the antenna beam at that time agrees with or substantially agrees with the azimuth angle of the satellite as viewed from the antenna device 11. Hence, if YES is given as the answer in the determination in Step 160, the operation proceeds to Step 162 to stop the rotation of the antenna supporting base 14 by the first motor 18. As a result, the antenna beam is set in the state of being oriented toward the satellite. Incidentally, if the receiving level does not exceed the predetermined value even if the antenna supporting base is rotated by one revolution, the antenna 22 may be rotated slightly to allow the elevation angle $\theta$ of the antenna beam to change slightly, and then the rotation of the antenna supporting base 14 and the receiving level may be monitored.

In an ensuing Step 164, the amount of change, $\Delta\phi_M$, in the azimuth angle of the antenna beam at the present angle $\phi_M$ of the antenna 22 is calculated in accordance with Formula (3). In Step 166, the angle $\phi_M$ is substituted for the present angle $\phi_0$ of the antenna 22, the present angle $\phi$ of the antenna supporting base 14 detected by the rotation-angle sensor 42 is substituted for the present angle $\phi_0$ of the antenna supporting base 14, and the amount of change, $\Delta\phi_M$, in the azimuth angle determined in the earlier Step 164 is substituted for the amount of change, $\Delta\phi_0$, in the azimuth angle of the antenna beam at the present angle of the antenna 22, thereby initializing the values of the respective variables.

After the initial acquisition operation is carried out as described above, in an ensuing Step 168 and thereafter, the satellite tracking operation is carried out. That is, in Step 168, a timer for execution of the satellite tracking operation is started. In an ensuing Step 170, a determination is made as to whether or not the timer has timed out, i.e., whether or not the timing for execution of the satellite tracking operation has arrived, and the operation waits until YES is given as the answer in the determination. If YES is given as the answer in the determination in Step 170, the operation proceeds to Step 172. In Step 172, the change in the elevation angle (change in the attitude in the direction of the elevation angle), $\Delta\Theta$, of the mobile object after the aforementioned initial acquisition operation or the previous satellite tracking operation, which has been detected by the elevation-angle-change detection sensor 62, is fetched, and the target elevation angle $\theta_M$ of the antenna beam for correcting the change in the elevation angle, $\Delta\Theta$, of the mobile object is calculated in accordance with the following formula:

$$\theta_M=\theta_0-\Delta\Theta$$

It should be noted that the target elevation angle $\theta_M$ of the antenna beam referred to here is the elevation angle of the antenna beam at a time when the x-axis (see FIGS. 5 and 6) is assumed to be horizontal (elevation angle=0). If there is a change in the elevation angle, $\Delta\Theta$, in the mobile object, the x-axis also becomes inclined by $\Delta\Theta$ in the direction of the elevation angle with respect to the horizontal direction, and the elevation angle of the satellite using the x-axis as a reference (elevation angle=0) also changes by $\Delta\Theta$. Hence, if the antenna 22 is rotated such that the elevation angle $\theta$ of the antenna beam using the x-axis as the reference agrees with the target elevation angle $\theta_M$ determined above, then the actual elevation angle of the antenna beam using the horizontal plane as a reference agrees with the target elevation angle $\theta_M$ initialized in Step 152 earlier, thereby allowing the elevation angle of the antenna beam to agree with the elevation angle of the satellite.

In ensuing Steps 174 to 180, in the same way as in Steps 104 to 110 in the flowcharts shown in FIGS. 9A and 9B, the target angle $\phi_M$ of the antenna 22 at the time when the elevation angle $\theta$ of the antenna beam becomes the target elevation angle $\theta_M$ determined in Step 172 is calculated (Step 174); the rotation angle $\phi'_M$ of the antenna 22 for setting the present angle $\phi_0$ of the antenna 22 to the target angle $\phi_M$ is calculated (Step 176); the amount of change, $\Delta\phi_M$, in the azimuth angle of the antenna beam at the time when the angle $\phi$ of the antenna 22 is the target angle $\phi_M$ is calculated (Step 178); and the difference $\Delta\phi'_M$ in the amount of change in the azimuth angle of the antenna beam at the time when the antenna 22 is rotated from the present angle $\phi_0$ to the target angle $\phi_M$ is calculated (Step 180).

In Step 182, the change in the azimuth angle (change in the attitude in the direction of the azimuth angle), $\Delta\psi$, of the mobile object after the aforementioned initial acquisition operation or the previous satellite tracking operation, which has been detected by the azimuth-angle-change detection sensor 64, is fetched, and the target azimuth angle $\phi_M$ of the antenna beam for correcting the change in the aximuth angle, $\Delta\psi$, of the mobile object is calculated in accordance with the following formula:

$$\phi_M=\phi_0-\Delta\psi$$

It should be noted that the target azimuth angle $\phi_M$ of the antenna beam referred to here is similarly the azimuth angle of the antenna beam at a time when the x-axis direction (see FIGS. 5 and 6) is assumed to be the reference (azimuth angle=0). If there is a change in the azimuth angle, $\Delta\psi$, in the mobile object, the x-axis direction also becomes inclined by $\Delta\psi$ in the direction of the azimuth angle with respect to the x-axis direction after the initial acquisition operation or the previous satellite tracking operation, and the azimuth angle of the satellite using the x-axis as a reference (azimuth angle=0) also changes by $\Delta\psi$. Hence, if the antenna supporting base 14 is rotated such that the azimuth angle $\phi$ of the antenna beam using the x-axis as the reference agrees with the target azimuth angle $\phi_M$ determined above, then the actual azimuth angle of the antenna beam agrees with the azimuth angle of the satellite.

In an ensuing Step 182, by taking into consideration the change in the azimuth angle of the antenna beam accompanying the rotation of the antenna 22, the rotation angle $\phi'_M$ of the antenna supporting base 14 from the present angle $\phi_0$ for setting the azimuth angle $\phi$ of the antenna beam to the target azimuth angle $\phi_M$ determined in Step 182 is calculated in accordance with the following formula:

$$\phi'_M=\phi_M-\phi'_0-\Delta\phi'_M$$

Then, in Step 186, the antenna 22 is rotated by the second motor 26 by the rotation angle $\phi'_M$ with respect to the antenna supporting base 14 while monitoring the rotation angle $\phi'$ of the antenna 22 detected by the rotation-angle sensor 48. In an ensuing Step 188, the antenna supporting base 14 is rotated by the first motor 18 by the rotation angle $\phi'_M$ with respect to the base 12 while monitoring the rotation angle $\phi'$ of the antenna supporting base 14 detected by the rotation-angle sensor 42. As a result, the elevation angle $\theta$ of the antenna beam comes to agree with the target elevation angle $\theta_M$ and the azimuth angle $\phi$ of the antenna beam comes to agree with the target azimuth angle $\phi_M$. Thus the elevation angle and the azimuth angle of the antenna beam are adjusted to allow the antenna beam to be directed toward the satellite irrespective of the change in the elevation angle, $\Delta\Theta$, and the change in the azimuth angle, $\Delta\psi$, of the mobile object.

In an ensuing Step 190, the target angle $\phi_M$ determined in Step 174 is substituted for the present angle $\phi_0$ of the antenna 22, a value in which the rotation angle $\phi'_M$ determined in Step 184 is added to the present angle $\phi_0$ is substituted for the present angle $\phi_0$ of the antenna supporting base 14, and the amount of change, $\Delta\phi_M$, in the azimuth angle determined in Step 178 is substituted for the amount of change, $\Delta\phi_0$, in the azimuth angle of the antenna beam at the present angle of the antenna 22, thereby updating the values of the respective variables.

In an ensuing Step 192, a determination is made as to whether or not the above-described control of the direction of the antenna beam is to be continued. If YES is the answer in the determination, the operation returns to Step 168 to start the timer, and the above-described processing is repeated after the lapse of a predetermined time. As a result, even in a case where there has been a change in the attitude in the direction of the elevation angle or in the direction of the azimuth angle of the mobile object, the antenna beam can always be directed toward the satellite, so that satellite communication can always be effected with satisfactory communication quality irrespective of a change in the attitude of the mobile object.

Although a description has been given above of effecting the satellite tracking operation on the basis of the change in the attitude, $\Delta\Theta$, in the direction of the elevation angle of the mobile object detected by the elevation-angle-change detection sensor 62 and the change in the attitude, $\Delta\psi$, in the direction of the azimuth angle of the mobile object detected by the azimuth-angle-change detection sensor 64, the present invention is not limited to the same. For example, as the satellite tracking operation, processing may be effected for controlling the elevation angle and the azimuth angle of the antenna beam such that the receiving level becomes maximum on the basis of the receiving level detected by the receiving level detecting unit 66. In addition, in cases where, for instance, the moving range of the mobile object is relatively narrow, or the change in the attitude in the direction of the elevation angle of the mobile object is small, the need for controlling the elevation angle of the antenna beam in the satellite tracking operation is small. In such a case, Steps 172 to 180 in FIG. 12B may be omitted (by setting the difference $\Delta\phi'_M$ in the amount of change in the azimuth angle of the antenna beam to 0), and only the azimuth angle of the antenna beam may be controlled.

Figure 13:
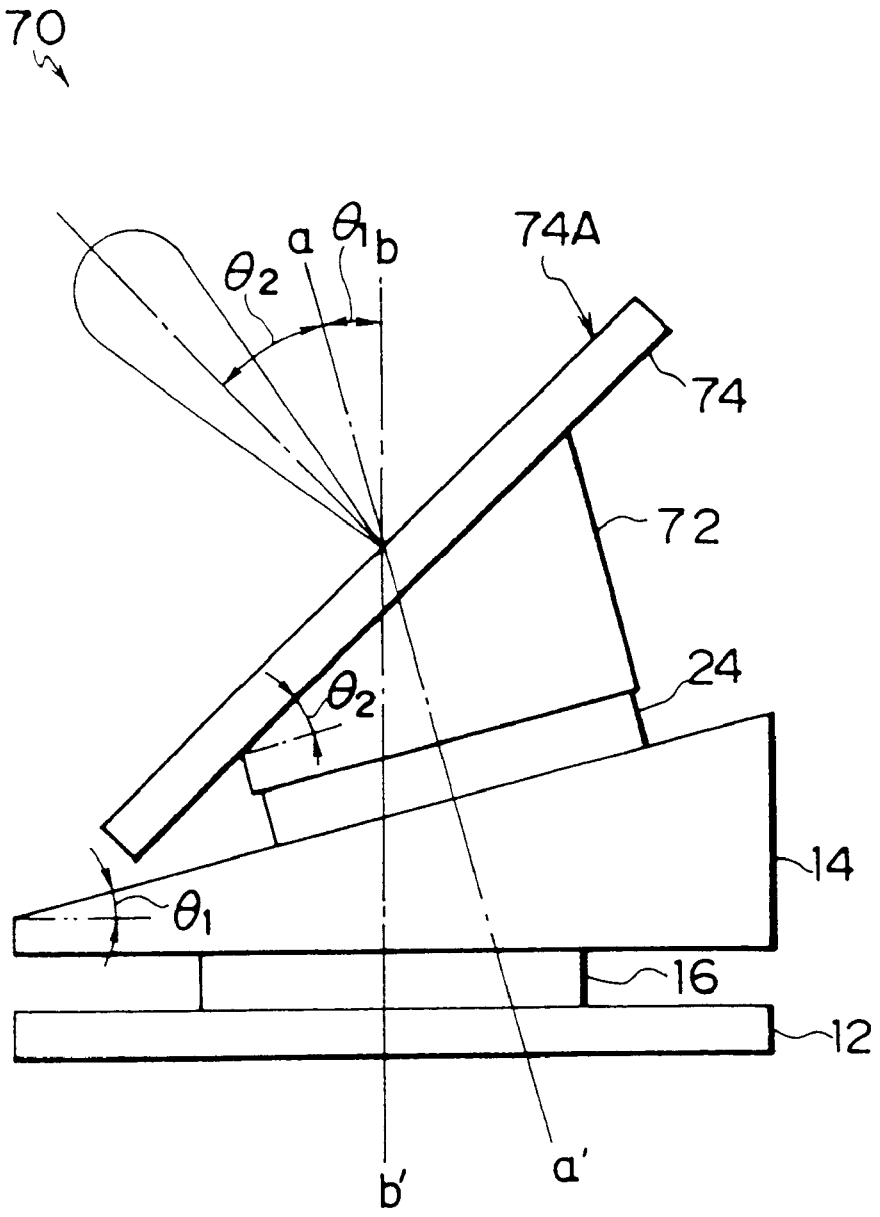
FIG. 13 is a side elevational view schematically illustrating a first alternative embodiment of the antenna device.

In addition, the antenna device of the directional beam controlling apparatus in accordance with the present invention is not limited to the configuration shown in FIGS. 1 to 3 and the configuration shown in FIG. 11. Hereafter, a description will be given of other embodiments of the antenna device. FIG. 13 shows a first alternative embodiment of the antenna device. An antenna device 70 shown in FIG. 13 has an inclined base 72 disposed above the antenna supporting base 14. In the same way as the antenna supporting base 14, this inclined base 72 has a such a shape that a circular cylinder at one axial end thereof is cut along a plane perpendicular to the axis, while the circular cylinder at another axial end thereof is cut at an angle of $(\pi/2-\theta_1)$ with respect to the axis, with the two ends closed.

The inclined base 72 is arranged such that its perpendicular surface perpendicular to the axis of the aforementioned cylinder becomes parallel with the inclined surface of the antenna supporting base 14, and the second bearing 24 serving as the second rotatably supporting portion is disposed between the inclined surface of the antenna supporting base 14 and the perpendicular surface of the inclined base 72. The inclined base 72 is arranged to be rotatable about an axis (line a–a': a rotational axis which is inclined by the first angle $\theta_1$ with respect to the first rotational axis (line b–b'), i.e., the second rotational axis) perpendicular to the inclined surface of the antenna supporting base 14 via the second bearing 24.

An antenna 74 is mounted on the inclined surface of the inclined base 72 in such a manner as to extend along the inclination of the inclined surface of the inclined base 72. It should be noted that the inclined base 72 and the antenna 74 correspond to the antenna portion of the present invention. The antenna 74 of the antenna device 70 is so configured that the range of gain at a predetermined value or higher is narrowed down to a beam shape, and the direction of the antenna beam is set to be perpendicular to an antenna aperture 74A, as shown in FIG. 13. Since the antenna 74 is mounted on the inclined surface of the inclined base 72 as described above, the direction of the antenna beam is mechanically inclined by the angle $\theta_2$ with respect to the second rotational axis by means of the inclined base 72.

Accordingly, in the same way as the antenna device 11, as the second motor 26 (not shown) is driven to rotate the inclined base 72 and the antenna 74 about the second rotational axis as a unit with respect to the antenna supporting base 14, the elevation angle $\theta$ (and the azimuth angle $\phi$) of the antenna beam changes. Further, as the first motor 18 is driven to rotate the antenna supporting base 14 about the first rotational axis (line b–b' in FIG. 13) with respect to the base 12, only the azimuth angle of the antenna beam changes.

Figure 14:
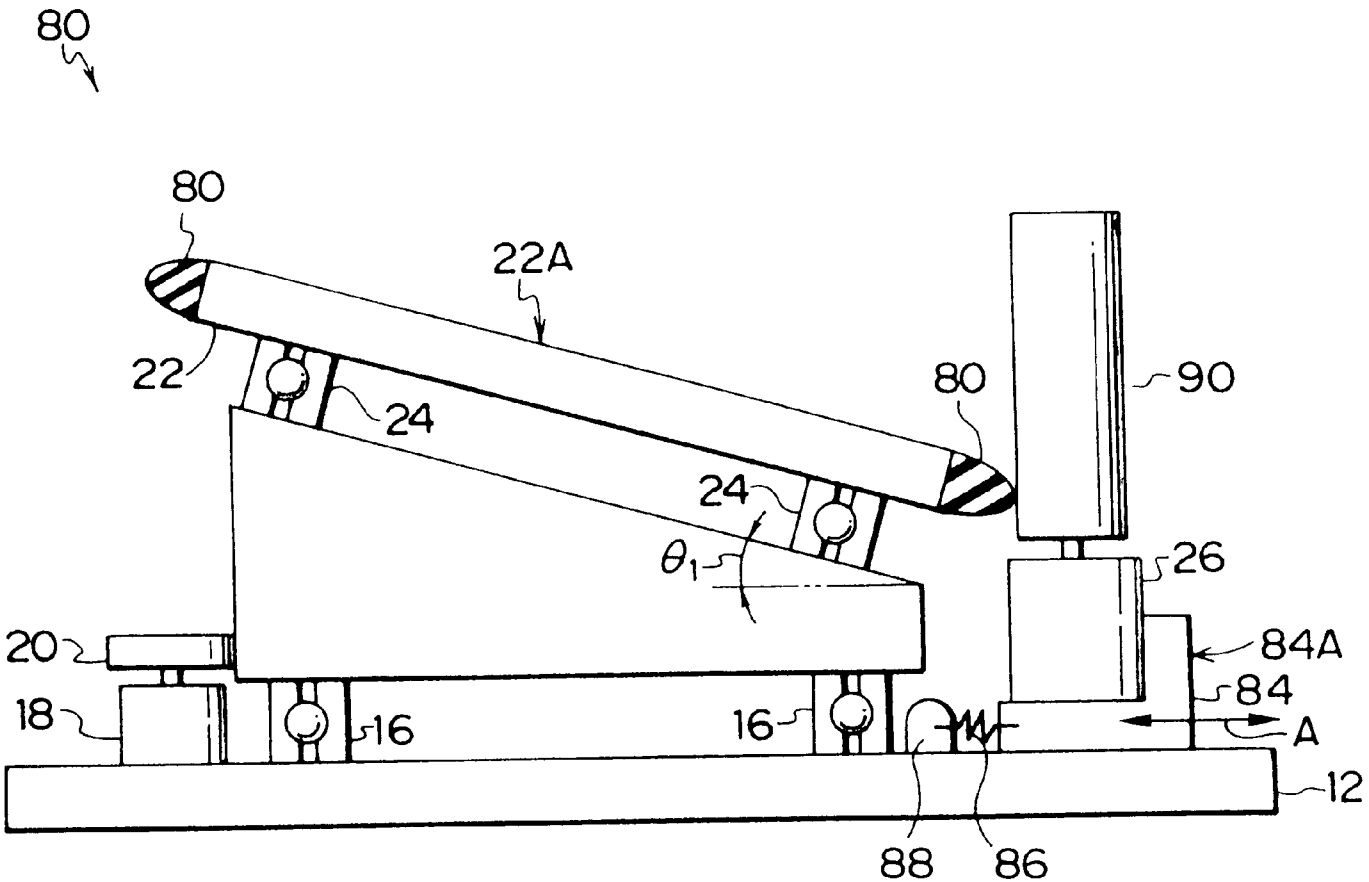
FIG. 14 is a cross-sectional view schematically illustrating a second alternative embodiment of the antenna device.

Next, referring to FIG. 14, a description will be given of a second alternative embodiment of the antenna device. In an antenna device 80 shown in FIG. 14, an outer peripheral end surface of the antenna 22 is covered with a material of a high coefficient of friction such as rubber over the entire periphery of the antenna 22 with a fixed thickness, and a covering portion 82 is thereby formed. Meanwhile, a sliding base 84 is disposed at a position which corresponds to the outer periphery of the antenna supporting base 14 on the base 12. The sliding base 84 is engaged with a rail (not shown) formed on the base 12, and is slidingly movable by means of the rail in the direction in which the sliding base 84 moves closer to or away from the antenna supporting base 14 (in the direction of the double-headed arrow A).

One end of an extension coil spring 86 is retained at the sliding base 84, and the other end of the extension coil spring 86 is retained at a retaining portion 88 provided at a position closer to the antenna supporting base 14 than the sliding base 84 on the base 12, so that the sliding base 84 is urged by the extension coil spring 86 in the direction in which the sliding base 84 moves closer to the antenna supporting base 14. The second motor 26 is mounted on the sliding base 84. In addition, a supporting wall 84A for supporting a side portion of the second motor 26 which is opposite its side portion facing the antenna supporting base 14 is provided uprightly on the sliding base 84. A roller 90, which is formed of a material of a high coefficient of friction such as rubber and whose axial length is set to be slightly longer than $D\sin\theta_1$ (where D is the diameter of the antenna 22 including the covering portion 82), is attached to a rotating shaft of the second motor 26.

Since the antenna aperture 22A of the antenna 22 is inclined by the angle $\theta_1$ with respect to the upper surface (horizontal plane) of the base 12, if the antenna 22 including the covering portion 82 is projected onto the horizontal plane, the outer shape becomes elliptical. Hence, if the antenna supporting base 14 and the antenna 22 rotate with respect to the base 12, in conjunction with this rotation the position along the horizontal direction of a diametrical end portion of the antenna 22 including the covering portion 82 changes at each position along the peripheral direction of the antenna 22 and, at the same time, the position (height) along the vertical direction of the diametrical end portion of the antenna 22 including the covering portion also changes by $D\sin\theta_1$ at maximum.

In contrast, the sliding base 84 on which the second motor 26 is mounted is slidingly movable in the direction in which the sliding base 84 moves closer to or away from the antenna supporting base 14, and is urged in the direction of moving closer to the antenna supporting base 14 by the extension coil spring 86, and since the axial length of the roller 90 is set to be slightly longer than $D\sin\theta_1$, even if the first motor 18 is driven and the antenna supporting base 14 and the antenna 22 are rotated with respect to the base 12, the outer peripheral surface of the roller 90 is constantly brought into contact with and pressed against the covering portion 82 irrespective of their angle of rotation. Hence, the antenna 22 can be rotated with respect to the antenna supporting base 14 by the second motor 26.

Since the second motor 26 for rotating the antenna 22 is provided on the base 12, the portions which are rotated by the first motor 18 (i.e., portions including the antenna supporting base 14 and the antenna 22) can be made lightweight. Accordingly, since a compact lightweight motor which generate relatively small torque can be used as the first motor 18, it is possible to make the antenna device compact and lightweight.

Figure 15:
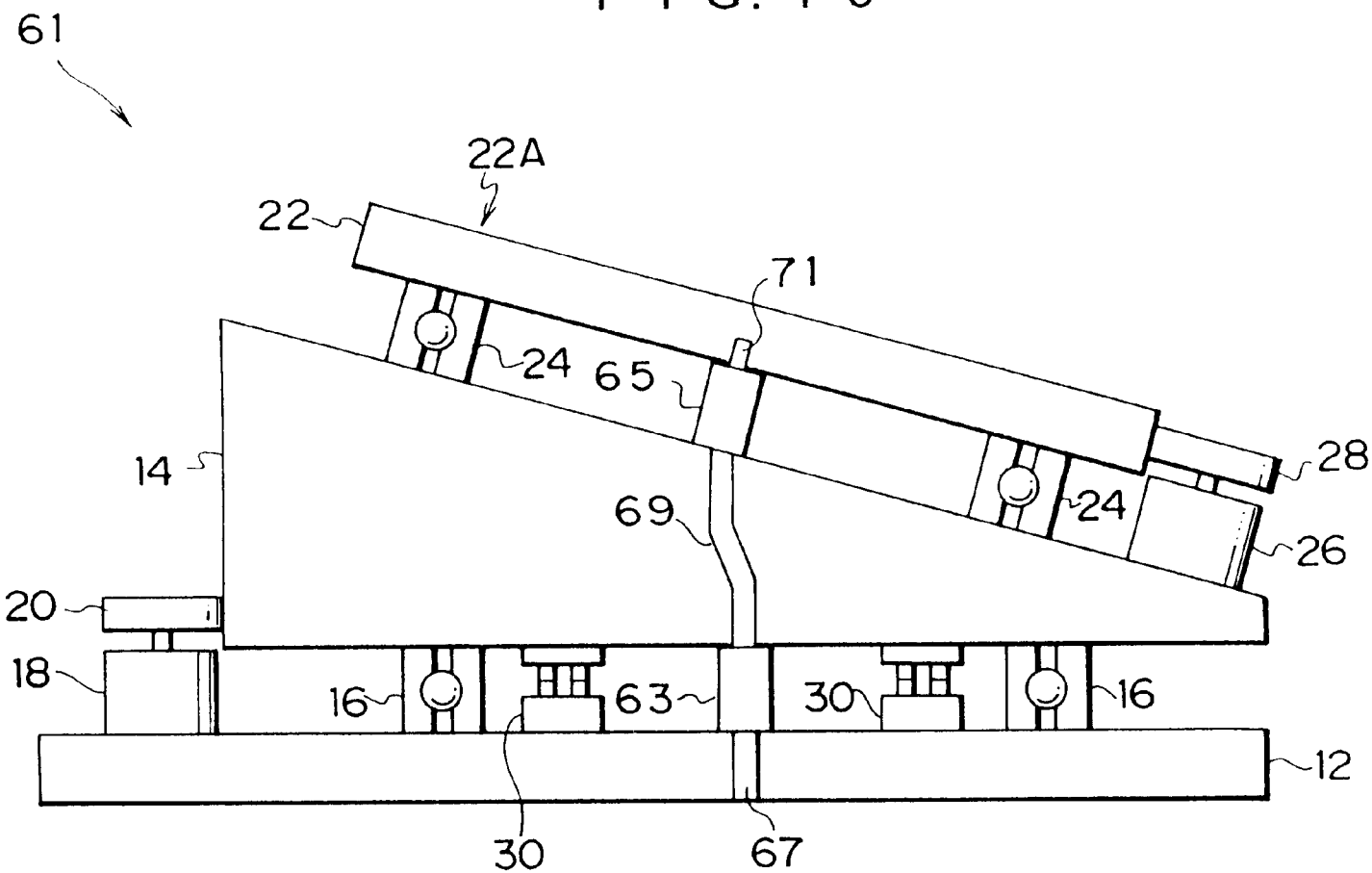
FIG. 15 is a side elevational view schematically illustrating a third alternative embodiment of the antenna device.

Next, referring to FIG. 15, a description will be given of a third alternative embodiment of the antenna device of the present invention. In an antenna device 61 shown in FIG. 15, instead of the feed line 32, a rotary joint 63 is provided on the first rotational axis between the base 12 and the antenna supporting base 14, while a rotary joint 65 is provided on the second rotational axis between the antenna supporting base 14 and the antenna 22.

An end of a coaxial cable 67 which is fixed to the base 12 is connected to the rotary joint 63 on the base 12 side thereof. One end of a coaxial cable 69 is connected to the rotary joint 63 on the antenna supporting base 14 side thereof, and the other end of the coaxial cable 69 is connected to the rotary joint 65 on the antenna supporting base 14 side thereof. Further, the antenna 22 side of the rotary joint 65 is connected to a feeding point of the antenna 22 via a probe 71.

With the antenna device 11, the distal end of the feed line 32 is inserted in the small hole 22B of the antenna 22 to feed the antenna 22 on a non-contact basis, but particularly in a case where the angle of inclination of the antenna 22 with respect to the base 12 is large, it is necessary to enlarge the inside diameter of the small hole 22B. Hence, there is a drawback in that the loss in a feeding portion becomes large as a result.

In contrast, with the antenna device 61, the rotary joint 65 and the feeding point of the antenna 22 are electrically connected via the probe 71, and the feeding of the antenna 22 is effected via the coaxial cable 67, the rotary joint 63, the coaxial cable 69, the rotary joint 65, and the probe 71. Therefore, even in a case where the angle of inclination of the antenna 22 with respect to the base 12 is large, the loss in the feeding portion does not increase. In addition, since the relative rotation of the base 12 and the antenna supporting base 14 and the relative rotation of the antenna supporting base 14 and the antenna 22 are absorbed as the rotary joints 63 and 65 rotate, with the result that it is possible to prevent twisting from occurring in the coaxial cable 69 and the like.

Figure 16:
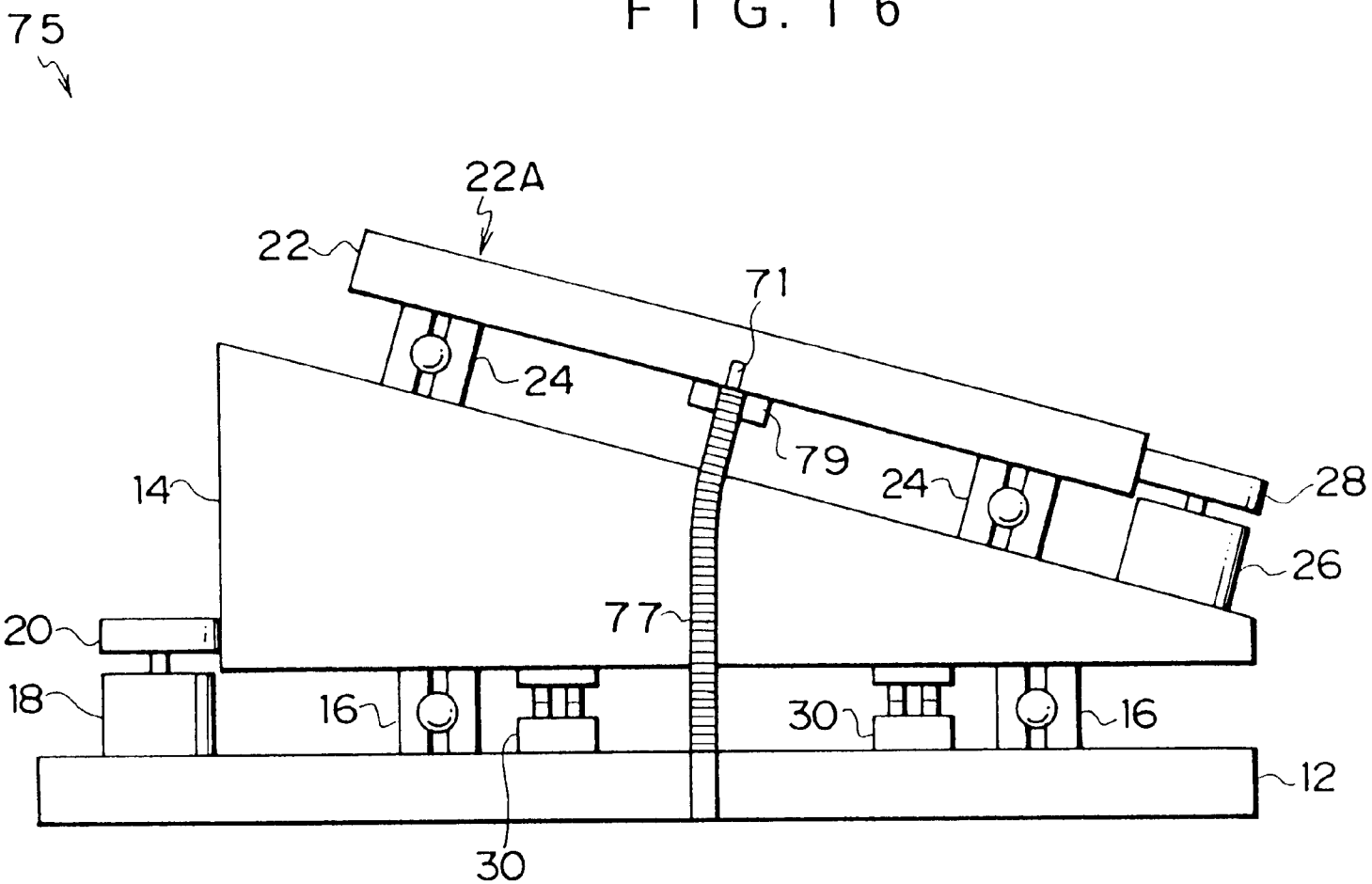
FIG. 16 is a cross-sectional view schematically illustrating a fourth alternative embodiment of the antenna device.

Next, referring to FIG. 16, a description will be given of a fourth alternative embodiment of the antenna device of the present invention. An antenna device 75 shown in FIG. 16 is provided with a flexible cable 77 instead of the feed line 32. The flexible cable 77 has one end fixed to the base 12 and its intermediate portion passed through the interior of the antenna supporting base 14, and the other end of the flexible cable 77 is electrically connected to the feeding point of the antenna 22 via a bearing 79 and the probe 71.

In the case of this antenna device 75 as well, the flexible cable 77 is electrically connected to the feeding point of the antenna 22 via the bearing 79 and the probe 71, and the feeding of the antenna 22 is effected via the flexible cable 77, the bearing 79, and the probe 71. Hence, even in a case where the angle of inclination of the antenna 22 with respect to the base 12 is large, the loss in the feeding portion does not increase. In addition, since the rotation of the antenna 22 with respect to the base 12 is absorbed as the bearing 79 rotates, with the result that it is possible to prevent twisting from occurring in the flexible cable 77. Further, if the antenna 22 rotates with respect to the base 12, the direction of inclination of the antenna 22 with respect to the base 12 changes, but this change in the direction of inclination can be absorbed as the intermediate portion of the flexible cable 77 is bent.

Figure 17:
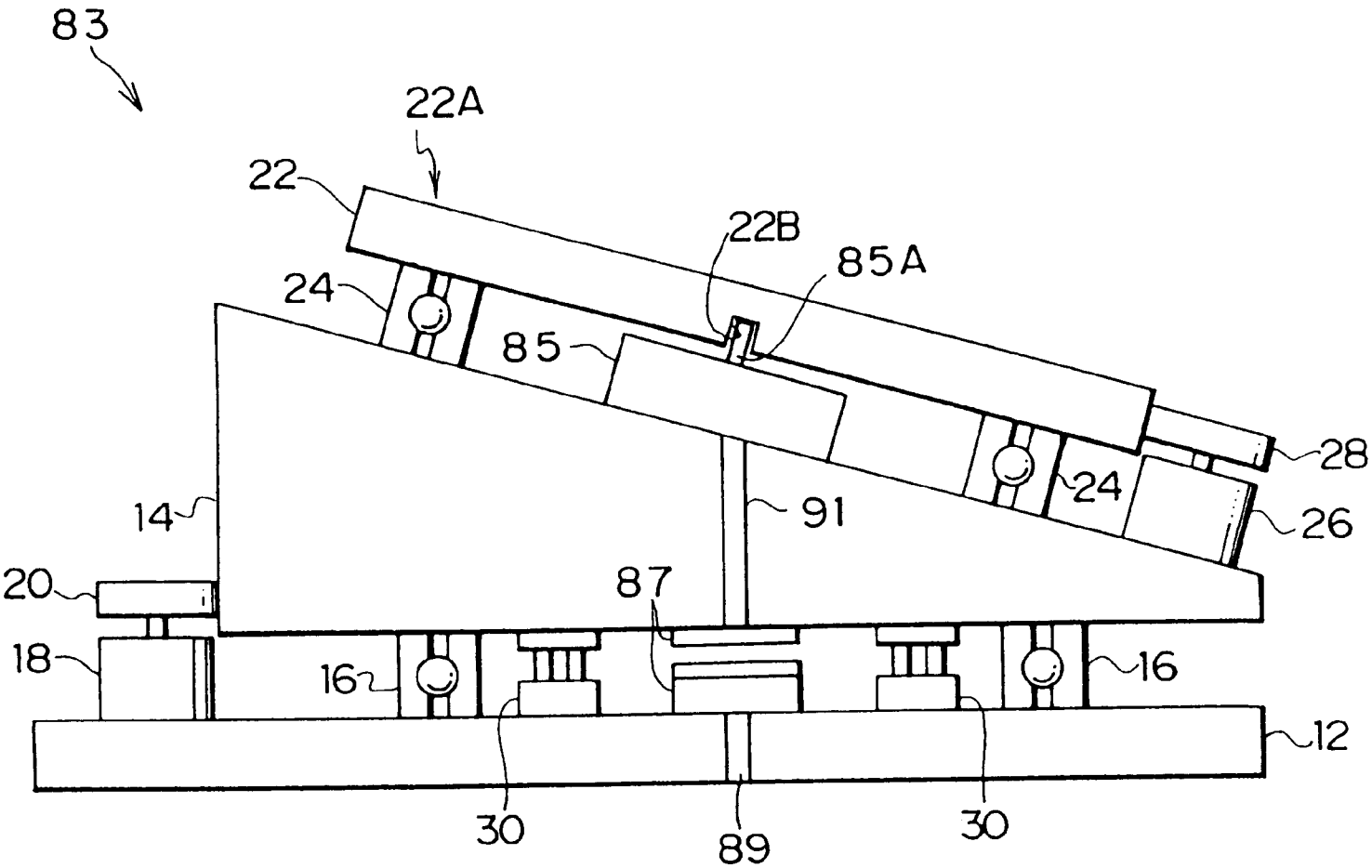
FIG. 17 is a cross-sectional view schematically illustrating a fifth alternative embodiment of the antenna device.

Next, referring to FIG. 17, a description will be given of a fifth alternative embodiment of the antenna device of the present invention. In an antenna device 83 shown in FIG. 17, a frequency conversion circuit 85 is mounted on the inclined surface of the antenna supporting base 14. A probe 85A projects from this frequency conversion circuit 85 along the second rotational axis, and the distal end of the probe 85A is inserted in the small hole 22B provided in the lower surface of the antenna 22. A signal received by the antenna 22 is inputted to the frequency conversion circuit 85 via the probe 85A, and the frequency conversion circuit 85 converts the frequency of the inputted signal to a lower frequency (intermediate frequency band).

In addition, a rotary joint 87 for the intermediate frequency band is provided between the base 12 and the antenna supporting base 14. An end of a coaxial cable 89 fixed to the base 12 is connected to the base 12 side of the rotary joint 87. One end of a coaxial cable 91 is connected to the antenna supporting base 14 side of the rotary joint 87, and the other end of the coaxial cable 91 is connected to the frequency conversion circuit 85.

With the directional beam antenna device 83, since the signal received by the antenna 22 is converted to a signal in the intermediate frequency band by the frequency conversion circuit 85, a relatively inexpensive rotary joint 87 for the intermediate frequency band can be used as the rotary joint for absorbing the relative rotation of the base 12 and the antenna supporting base 14. Accordingly, it is possible to lower the cost of the directional beam antenna device.

In addition, since the frequency conversion circuit 85 is mounted on the antenna supporting base 14, the probe 85A can be arranged along the second rotational axis. As a result, it is possible to avoid interference with the probe 85A irrespective of the angle of inclination of the antenna 22 with respect to the base 12 even if the inside diameter of the small hole 22B is made relatively small. Therefore, even if the angle of inclination of the antenna 22 with respect to the base 12 is large, it is possible to prevent the loss in the feeding portion from becoming large.

In addition, the directional beam antenna device and the directional beam controlling apparatus in accordance with the present invention are not limited to the use as an antenna of a mobile earth station by being mounted in a mobile object such as a vehicle, and may be used as an antenna of a fixed earth station, or may be used in communications in other forms of communication in which a satellite is not used.

What is claimed is:

1. A directional beam antenna device comprising:

an antenna supporting member which is supported on a base in such a manner as to be rotatable about a first rotational axis;

an antenna portion, having an antenna aperture, which is supported on said antenna supporting member in such a manner as to be rotatable about a second rotational axis which is perpendicular to the antenna aperture and is inclined at a first angle with respect to the first rotational axis, the direction of an antenna beam being inclined at a second angle with respect to the second rotational axis;

first driving means for rotating said antenna supporting member about the first rotational axis with respect to said base; and second driving means for rotating said antenna portion about the second rotational axis with respect to said antenna supporting member, an amount of rotation about the second rotational axis being dependent on an amount of rotation by said first driving means so as to point the direction of the antenna beam in a predetermined direction, wherein the antenna supporting member has a perpendicular surface that is perpendicular to the first rotational axis and an inclined surface that is perpendicular to the second rotational axis, the perpendicular surface being supported on said base, and the inclined surface supporting the antenna portion, and wherein a plane of the antenna portion is substantially parallel to the inclined surface of the antenna supporting member.

2. The directional beam antenna device according to claim 1, wherein said antenna portion is a planar antenna or an antenna in which the direction of the antenna beam is electronically tilted by a predetermined angle with respect to the direction of a normal line of a radiational aperture.

3. The directional beam antenna device according to claim 1, wherein the first rotational axis extends in a substantially vertical direction.

4. The directional beam antenna device according to claim 1, wherein said first driving means is provided on said antenna supporting member or said base, and said second driving means is provided on one of said antenna portion, said antenna supporting member, and said base.

5. The directional beam antenna device according to claim 1, further comprising feeding means for feeding to said antenna portion, said feeding means being one of a feed line fixed to said base or said antenna supporting member and having a distal end inserted in a small hole provided in a center of rotation of said antenna portion, a rotary joint provided in at least one of a space between said antenna portion and said antenna supporting member and a space between said base and said antenna supporting member, a flexible feed line having one end fixed to said base and another end connected rotatably to said antenna portion, and a frequency conversion circuit disposed on said antenna supporting member.

6. A directional beam controlling apparatus comprising:

an antenna supporting member which is supported on a base in such a manner as to be rotatable about a first rotational axis extending in a substantially vertical direction;

an antenna portion with an antenna aperture which is supported on said antenna supporting member in such a manner as to be rotatable about a second rotational axis which is perpendicular to the antenna aperture and is inclined at a first angle with respect to the first rotational axis, the direction of an antenna beam being inclined at a second angle with respect to the second rotational axis;

first driving means for rotating said antenna supporting member about the first rotational axis with respect to said base;

second driving means for rotating said antenna portion about the second rotational axis with respect to said antenna supporting member; and controlling means for controlling an elevation angle of the antenna beam to a target value by causing said second driving means to rotate said antenna portion with respect to said antenna supporting member, and for controlling an azimuth angle of the antenna beam to a target value by causing said first driving means to rotate said antenna supporting member with respect to said base, an amount of rotation by said first driving means effecting an amount of rotation required by said second driving means, wherein the antenna supporting member has a perpendicular surface that is perpendicular to the first rotational axis and an inclined surface that is perpendicular to the second rotational axis, the perpendicular surface being supported on said base and the inclined surface supporting the antenna portion, and wherein a plane of the antenna portion is substantially parallel to the inclined surface of the antenna supporting member.

7. The directional beam controlling apparatus according to claim 6, wherein said antenna portion is a planar antenna or an antenna in which the direction of the antenna beam is electronically tilted by a predetermined angle with respect to the direction of a normal line of a radiational aperture.

8. The directional beam controlling apparatus according to claim 6, wherein said first driving means is provided on said antenna supporting member or said base, and said second driving means is provided on one of said antenna portion, said antenna supporting member, and said base.

9. The directional beam controlling apparatus according to claim 6, further comprising feeding means for feeding to said antenna portion, said feeding means being one of a feed line fixed to said base or said antenna supporting member and having a distal end inserted in a small hole provided in a center of rotation of said antenna portion, a rotary joint provided in at least one of a space between said antenna portion and said antenna supporting member and a space between said base and said antenna supporting member, a flexible feed line having one end fixed to said base and another end connected rotatably to said antenna portion, and a frequency conversion circuit disposed on said antenna supporting member.

10. The directional beam controlling apparatus according to claim 6, further comprising:

first rotation-angle detecting means for detecting a rotation angle of said antenna supporting member with respect to said base; and second rotation-angle detecting means for detecting a rotation angle of said antenna portion with respect to said antenna supporting member, wherein said controlling means controls the elevation angle of the antenna beam and the azimuth angle of the antenna beam, respectively, to the target values on the basis of results of detection by said first and said second rotation-angle detecting means.

11. The directional beam controlling apparatus according to claim 6, further comprising:

second rotation-angle detecting means for detecting a rotation angle of said antenna portion with respect to said antenna supporting member, wherein said controlling means determines a change in the angle of said antenna portion about the second rotational axis with respect to said antenna supporting member on the basis of the rotation angle of said antenna portion with respect to said antenna supporting member detected by said second rotation-angle detecting means when said antenna supporting member is rotated by said first driving means.

12. The directional beam controlling apparatus according to claim 6, further comprising:

angular-change detecting means for detecting at least one of a change in the elevation angle and a change in the azimuth angle with respect to an object of orientation of the antenna beam, wherein said controlling means changes at least one of the target value of the elevation angle of the antenna beam and the target value of the azimuth angle of the antenna beam on the basis of at least one of the change in the elevation angle and the change in the azimuth angle with respect to the object of orientation of the antenna beam detected by said angular-change detecting means.

13. The directional beam controlling apparatus according to claim 12, wherein said angular-change detecting means is at least one of elevation-angle-change detecting means for detecting the change in the elevation angle of the object of orientation of the antenna beam by detecting a change in a location and an attitude of a mobile object and azimuth-angle-change detecting means for detecting the change in the azimuth angle of the object of orientation of the antenna beam by detecting the change in the location and the attitude of the mobile object.

14. The directional beam controlling apparatus according to claim 12, wherein said angular-change detecting means comprises arriving-direction detecting means for detecting at least one of the elevation angle and the azimuth angle of the direction of arrival of an electromagnetic wave by detecting a received signal level of the electromagnetic wave transmitted from the object of orientation of the antenna beam and received by said antenna portion.

15. The directional beam controlling apparatus according to claim 6, wherein the target value of the azimuth angle of the antenna beam is a value for correcting the change in the azimuth angle of the antenna beam which occurs when the elevation angle of the antenna beam is controlled to the target value by causing said second driving means to rotate said antenna portion with respect to said antenna supporting member.

* * * * *